US005695181A

United States Patent [19]

Yamanaka

[11] Patent Number: 5,695,181

[45] Date of Patent: Dec. 9, 1997

[54] SHEET SORTING APPARATUS

[75] Inventor: Yuji Yamanaka, Kawasaki, Japan

[73] Assignee: Canon Kabushiki Kaisha, Tokyo, Japan

[21] Appl. No.: 523,818

[22] Filed: Sep. 6, 1995

[30] Foreign Application Priority Data

Sep. 13, 1994 [JP] Japan ..... 6-218727

[51] Int. Cl.[6] ..... B65H 39/02

[52] U.S. Cl. ..... 270/58.08; 270/58.01

[58] Field of Search ..... 270/58.01, 58.02, 270/58.04, 58.08, 58.14

[56] References Cited

U.S. PATENT DOCUMENTS

| | | | |
|---|---|---|---|
| 5,221,953 | 6/1993 | Higaki | 270/58.08 |
| 5,282,012 | 1/1994 | Mandel et al. | 270/58.14 |
| 5,342,034 | 8/1994 | Mandel et al. | 270/58.08 |
| 5,348,279 | 9/1994 | Lambregts et al. | 270/58.08 |
| 5,374,043 | 12/1994 | Mandel et al. | 270/58.14 |
| 5,434,661 | 7/1995 | Takahashi et al. | 270/58.08 |
| 5,478,061 | 12/1995 | Murakami et al. | 270/58.08 |
| 5,524,873 | 6/1996 | Hosoi et al. | 270/58.08 |
| 5,531,430 | 7/1996 | Tokunoh | 270/58.02 |
| 5,580,039 | 12/1996 | Takehara et al. | 270/58.14 |

*Primary Examiner*—John T. Kwon

*Attorney, Agent, or Firm*—Fitzpatrick, Cella, Harper & Scinto

[57] ABSTRACT

A sheet containing and stacking apparatus includes sheet bundle discharge device and stacking device for stacking the discharged sheet bundles. It further includes auxiliary containing device reciprocally shiftable between an entrance position where the auxiliary containing device receives the sheet bundle discharged from the sheet bundle discharge device and a retard position where the received sheet bundle is shifted to the stacking device, and control device for reciprocally shifting the auxiliary containing device whenever the sheet bundle is stacked on the stacking device. Wherein a plurality of sheet bundles are successively stacked on the stacking device in an overlapped condition.

17 Claims, 24 Drawing Sheets

SHEET SORTING APPARATUS

BACKGROUND OF THE INVENTION

1. Field of the Invention

The present invention relates to a sheet containing and stacking apparatus, and more particularly, it relates to a sheet sorting apparatus for sorting and receiving sheets or sheet bundles sent, for example, from a copying machine having a reading apparatus, a facsimile machine having a communication function, a printer connected to a computer, or a stapling apparatus (such as a stapler, a pasting apparatus or the like), which is connected to the sheet sorting apparatus.

2. Related Background Art

In the past, as sheet receiving (containing) apparatuses, sorters and stackers disposed at a downstream side of an outlet of an image forming apparatus or at a downstream side of an outlet of a sheet post-treating apparatus such as a stapler were well-known. Such a sheet containing apparatus serves to successively stack and contain sheets or sheet bundles by discharging the sheets or the sheet bundles onto a bin tray or an intermediate plate.

However, in the conventional sheet containing apparatuses, since the sheets or the sheet bundles are discharged substantially horizontally onto a tray by a discharge means (FIG. 24A), there arises the following problems:

(1) When the sheets were already stacked on the tray, if a sheet bundle is discharged onto the tray, the already stacked sheets are pushed out of the tray or registration of the stacked sheets is disordered; and (2) When the stapled sheet bundle is rested on the tray, if a sheet is discharged onto the tray, a tip end of the discharged sheet is caught by the staple (FIG. 24B).

SUMMARY OF THE INVENTION

The present invention aims to solve the above-mentioned problems, and an object of the present invention is to provide a sheet containing and stacking apparatus in which sheet or sheet bundles are smoothly contained and stacked.

To achieve the above object, according to the present invention, there is provided a sheet containing and stacking apparatus comprising a discharge means, a containing means, and an auxiliary containing means capable of protruding above the containing means. The auxiliary containing means can perform a reciprocal movement to alternately protrude the auxiliary means above the containing means and retract the auxiliary means. More particularly, in the protruded condition, the auxiliary containing means receives a sheet or a sheet bundle discharged from the discharge means and temporarily contains the sheet or the sheet bundle. Then, by retracting the auxiliary containing means, the sheet or the sheet bundle is shifted to (dropped onto) the containing means to be received therein.

Accordingly, by using the reciprocal auxiliary containing means, the sheet can be dropped. That is to say, since the sheet is not discharged toward a sheet advancing direction, but it is dropped downwardly by a gravity force, the sheet can be contained stably, for example, without catching the sheet by a staple.

Further, in the case where a lift/lower means is provided, by lifting or lowering the auxiliary containing means, the dropping distance of the sheet can be decreased even on the containing means disposed at a high level, thereby containing the sheet stably.

The present invention can further provide a sheet containing and stacking apparatus comprising a plurality of inlet convey means, a plurality of lift/lower convey members for containing portions, and a plurality of auxiliary containing means. By providing the plurality of inlet convey means, the sheets and the sheet bundles from various image forming apparatuses or book-binding apparatuses can be received, and, by lifting or lowering the lift/lower convey members, the latter can be aligned with the corresponding inlet convey means so that the sheets and the sheet bundles can be discharged into the plurality of containing portions. By providing the auxiliary containing means On the lift/lower convey members, the sheets and the sheet bundles can be stably contained in the various containing portions.

Furthermore, by providing a vertical convey path, the sheets conveyed through the vertical convey path can be continuously discharged into the containing portion without lifting or lowering the lift/lower convey member to the vicinity of the inlet convey means for each sheet.

Further, preferably, the auxiliary containing means comprises three or more flat surface portions, and a bin bent portion of the containing portion is provided with three or more notches positioned in correspondence to the three or more flat surface portions. With this arrangement, after the auxiliary containing means is protruded above the containing portion and the sheets are stacked on the auxiliary containing means, when the auxiliary containing means is returned to its initial position, the sheets abut against the bin bent portion, thereby preventing the sheets from shifting out of the containing portion together with the auxiliary containing means. Further, by providing three or more notches, each sheet can abut against the bin bent portion at least two positions, thereby stabilizing the posture of the sheet.

Further, preferably, even regarding the smallest sheet, an area of the auxiliary containing means which supports the sheet is selected to become 60% or more of the entire area of the sheet, and a narrow rib is provided on the sheet supporting surface along a sheet advancing direction. With this arrangement, when the sheet is discharged onto the auxiliary containing means, an air layer is formed between the sheet and the auxiliary containing means so that the sheet can slide on the auxiliary containing means smoothly to abut against a reference wall.

BRIEF DESCRIPTION OF THE DRAWINGS

FIG. 5A is a plan view, FIG. 5B is an elevational view, and FIG. 5C is a right end view;

DESCRIPTION OF THE PREFERRED EMBODIMENTS

The present invention will now be explained in connection with embodiments thereof with reference to the accompanying drawings.

(FIRST EMBODIMENT)

Figure 1:
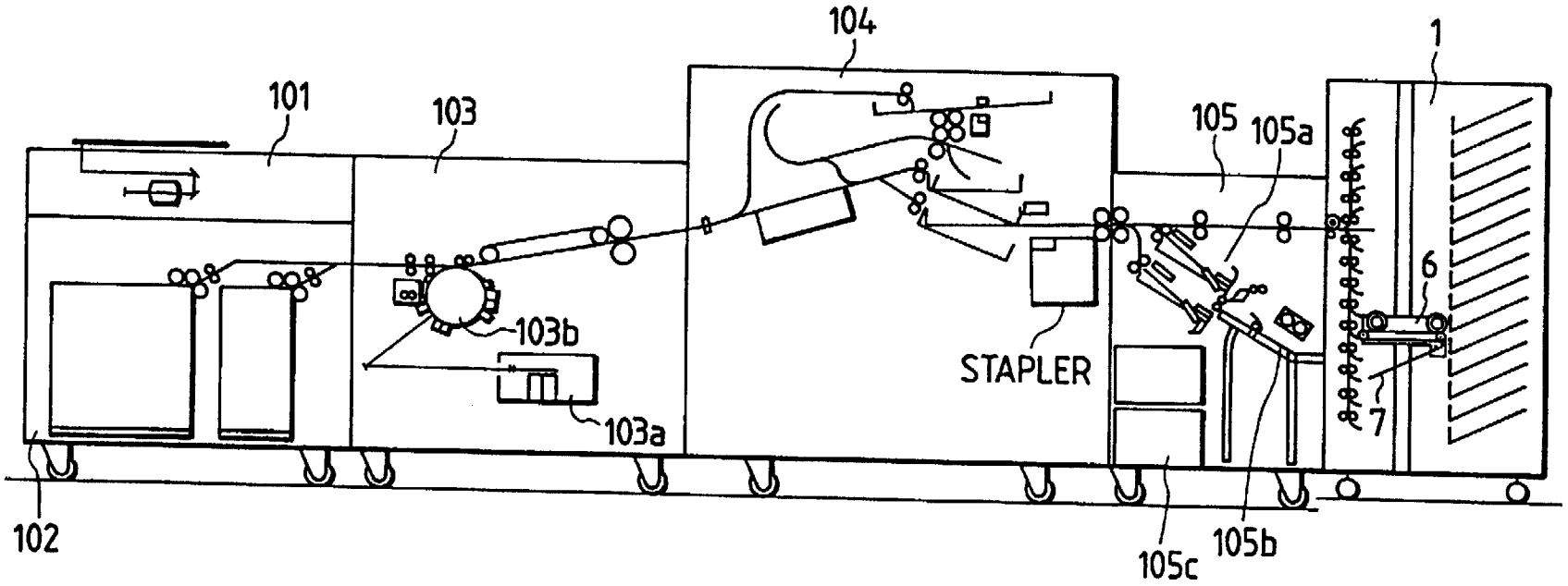
FIG. 1 is an elevational sectional view of an image forming system having a sheet containing and stacking apparatus (sheet distributing apparatus) according to the present invention and an image forming apparatus.
Figure 2:
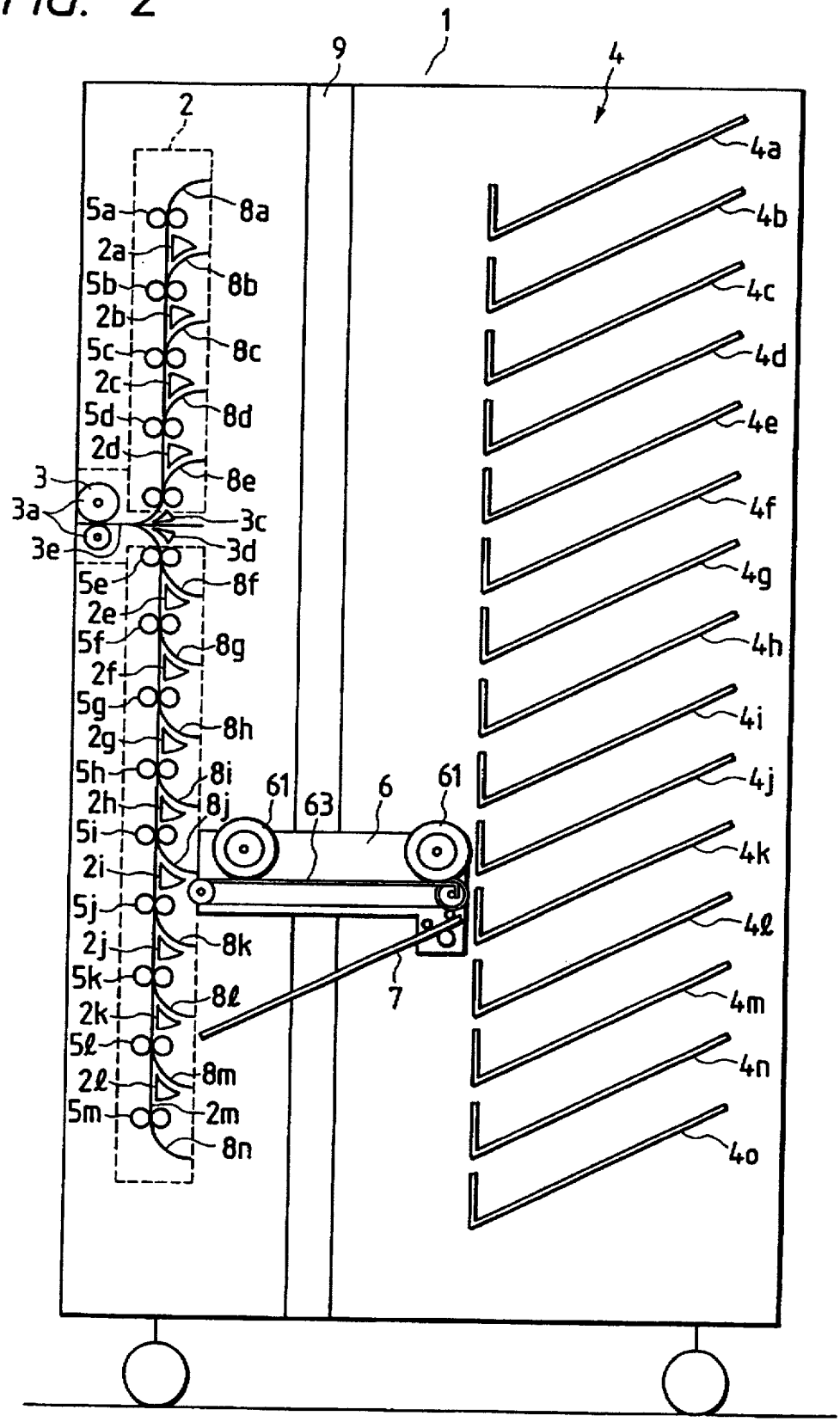
FIG. 2 is an enlarged elevational sectional view of the sheet discharging apparatus.

FIG. 1 is an elevational sectional view of an image forming system including a sheet containing and stacking apparatus (sheet sorting and containing apparatus) according to a first embodiment of the present invention, and FIG. 2 is an elevational sectional view of the sheet sorting and containing apparatus of FIG. 1.

In FIG. 1, the image forming system comprises an original reading apparatus 101 including an optical system, a sheet supply apparatus 102 including decks and cassettes and the like, and an image forming apparatus 103 including a laser scanner 103*a*, a photosensitive drum 103*b* and the like. The laser scanner 103*a* acts as a writing apparatus for writing an image on the photosensitive drum 103*b*, wherein an image read by the reading apparatus 101 is written on the photosensitive drum 103*b*, or, after communication contents from a network is received from a memory, and an image corresponding to the communication contents is written on the photosensitive drum 103*b* by a laser beam. The image forming system further comprises a stapling apparatus (finisher) 104 including a stapler a discharge tray and the like, a book-binding apparatus 105 including a pasting portion 105*a*, an elevator 105*b* and a discharge stacker 105*c*, and a sheet sorting and containing apparatus 1 according to the present invention.

Next, the sheet sorting and containing apparatus according to this embodiment will be explained with reference to FIG. 2.

In FIG. 2, the sheet sorting and containing apparatus includes a sheet inlet portion 3 which serves to receive a single sheet sent from the stapling apparatus 104 of the system or a sheet bundle book-bound by the stapler or a glue binder and direct the sheet or the sheet bundle to a vertical direction or a horizontal direction. Thus, the sheet inlet portion 3 is provided with a pair of inlet rollers (convey means) 3*a* and a straight path 3*a* to direct the single sheet S or a sheet bundle having a thickness smaller than a predetermined thickness (including sheet bundles smaller than eight sheets) upwardly or downwardly (into a vertical convey path 2 which will be described later) or to direct a sheet bundle having a thickness greater than the predetermined thickness (including sheet bundles more than nine sheets) horizontally (into a lift/lower convey member 6 which will be described later). Further, as a branch means for changing a direction of the sheet or the sheet bundle, there are provided solenoid-operated flappers 3*c*, 3*d*. One of the paired inlet rollers 3*a* is constituted by a drive roller, and the other is constituted by a driven roller which is shifted away from the drive roller when the sheet bundle having the thickness greater than the predetermined thickness reaches the paired inlet rollers and then is returned to pinch the sheet bundle after the sheet bundle enters between the paired inlet rollers.

The vertical convey path 2 is continuously disposed at a downstream side of the sheet inlet portion 3 and serves to convey the single sheet or the thin sheet bundle directed upwardly or downwardly at the sheet inlet portion 3 in an upward or downward direction. In the vertical convey path 2, there are provided a plurality of solenoid-operated flappers 2*a* to 21 which are disposed at levels corresponding to a plurality of trays 4*a* to 4*o* in a containing portion 4. The flappers 2*a* to 2*l* serve to change the direction of the single sheet or the thin sheet bundle having the thickness smaller than the predetermined thickness to direct it to the lift/lower convey member 6 which will be described later. Further, the vertical convey path 2 is provided with pairs of sheet feed rollers 5*a* to 5*m* which are arranged at a mutual distance smaller than a size of the smallest sheet. In addition, a convey guide 2 for guiding the single sheet or the thin sheet bundle having the thickness smaller than the predetermined thickness is disposed substantially vertically, and branch paths 8*a* to 8*n* comprised of bent sheet guides are disposed in association with the flappers 2*a* to 2*l*.

The lift/lower convey member 6 is disposed at downstream sides of the branch paths 8*a* to 8*n* of the vertical convey path 2 and serves to pinch and convey the sheet or the thin sheet bundle branched by the sheet inlet portion 3 and the vertical convey path 2. When the thick sheet bundle stapled in the upstream stapling apparatus 104 is conveyed horizontally through the sheet inlet portion 3, the lift/lower convey member 6 is aligned with the sheet inlet portion 3 to receive the stapled sheet bundle and lifts or lowers the sheet bundle to a level of the selected tray 4*a* to 4*o*. The lift/lower convey member 6 is guided by two rails 9 and rail rollers 9*a* (FIG. 3) and is lifted or lowered by a drive wire (not shown).

Figure 3:
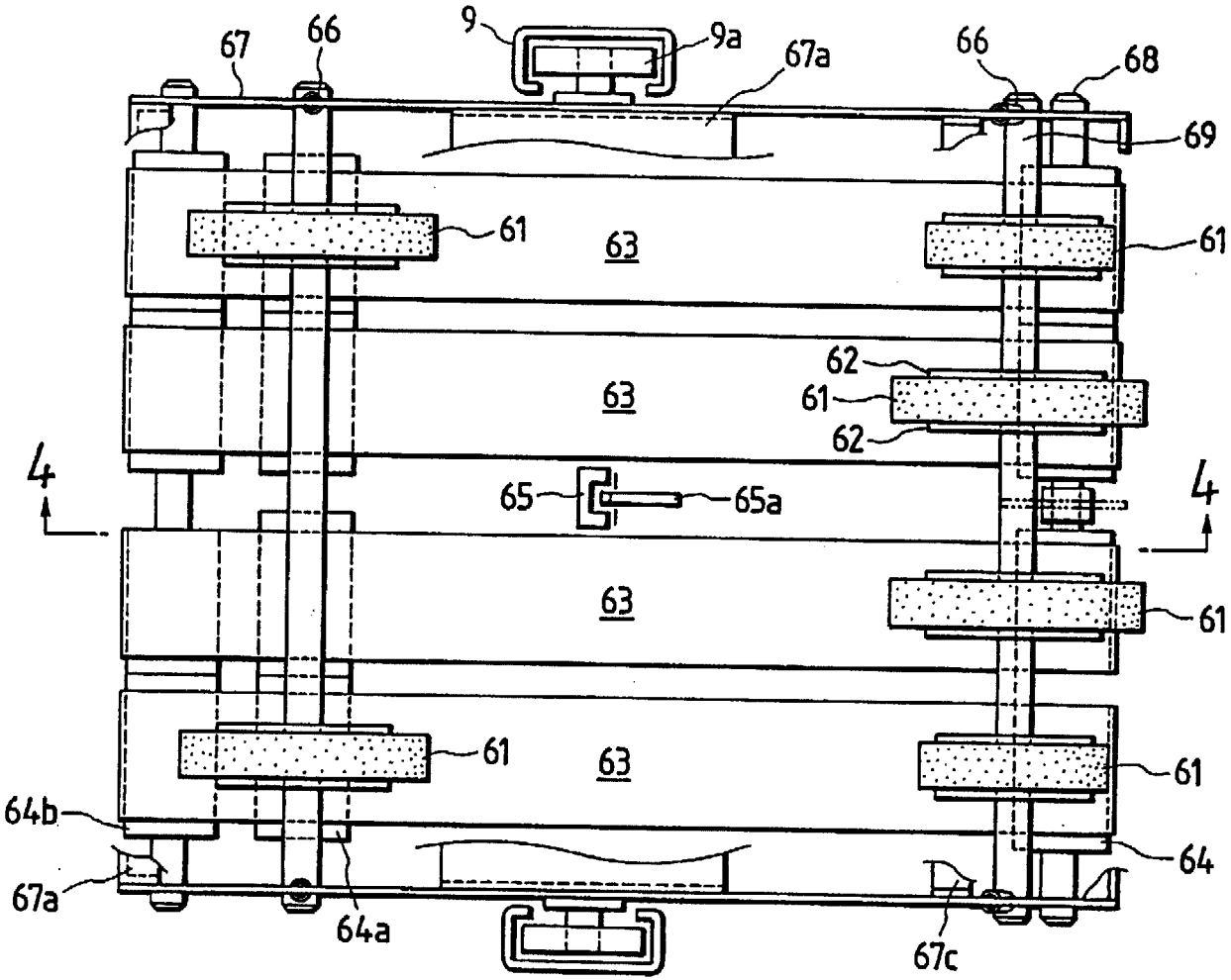
FIG. 3 is an enlarged plan view of a lift/lower convey member of FIG. 2.
Figure 4:
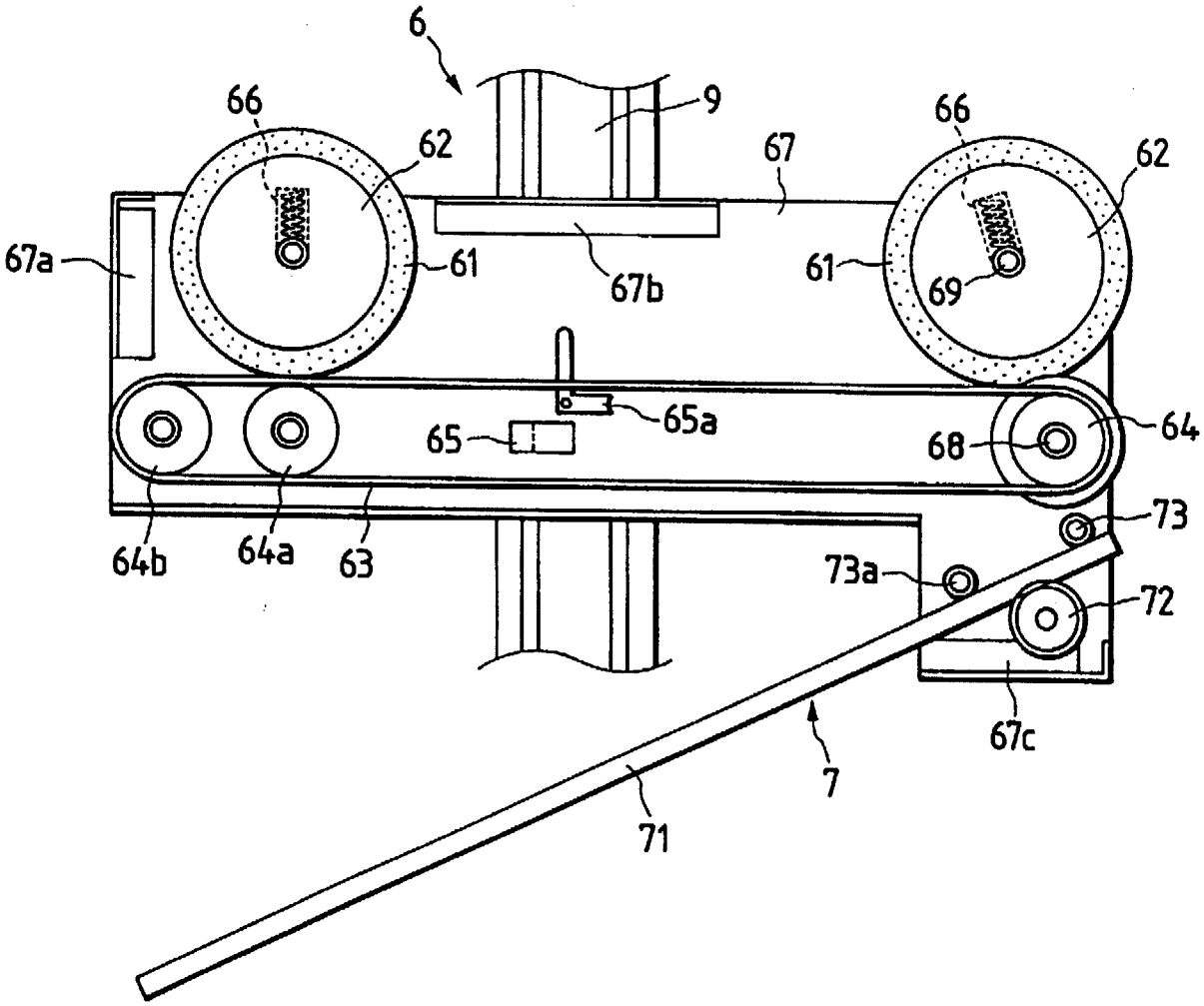
FIG. 4 is a sectional view taken along the line 4—4 in FIG. 3.
Figure 5C:
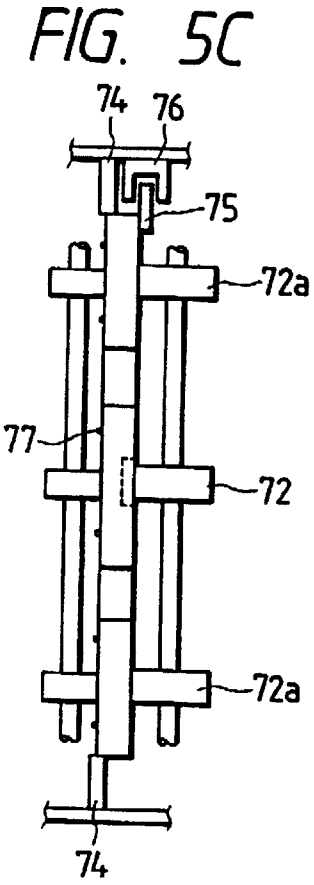
FIGS. 5A to 5C are views for explaining an auxiliary containing means of FIG. 4, where
Figure 5A:
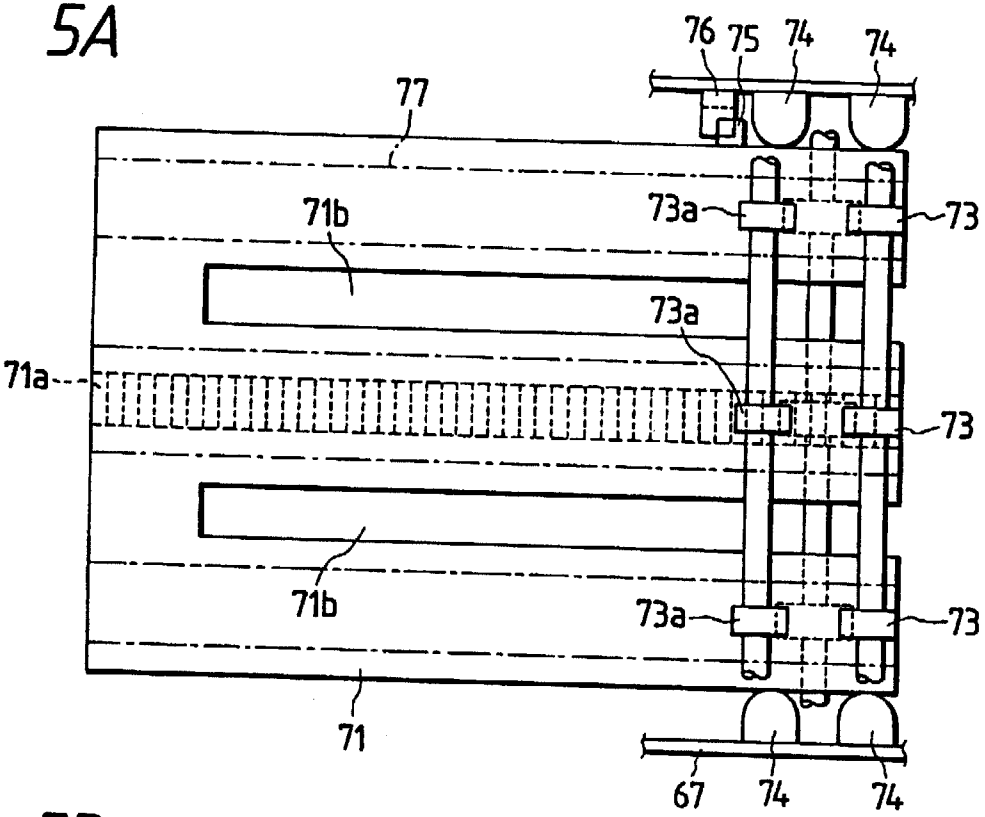
Figure 5B:
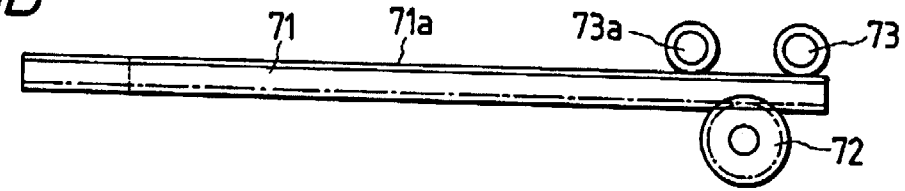
Figure 6:
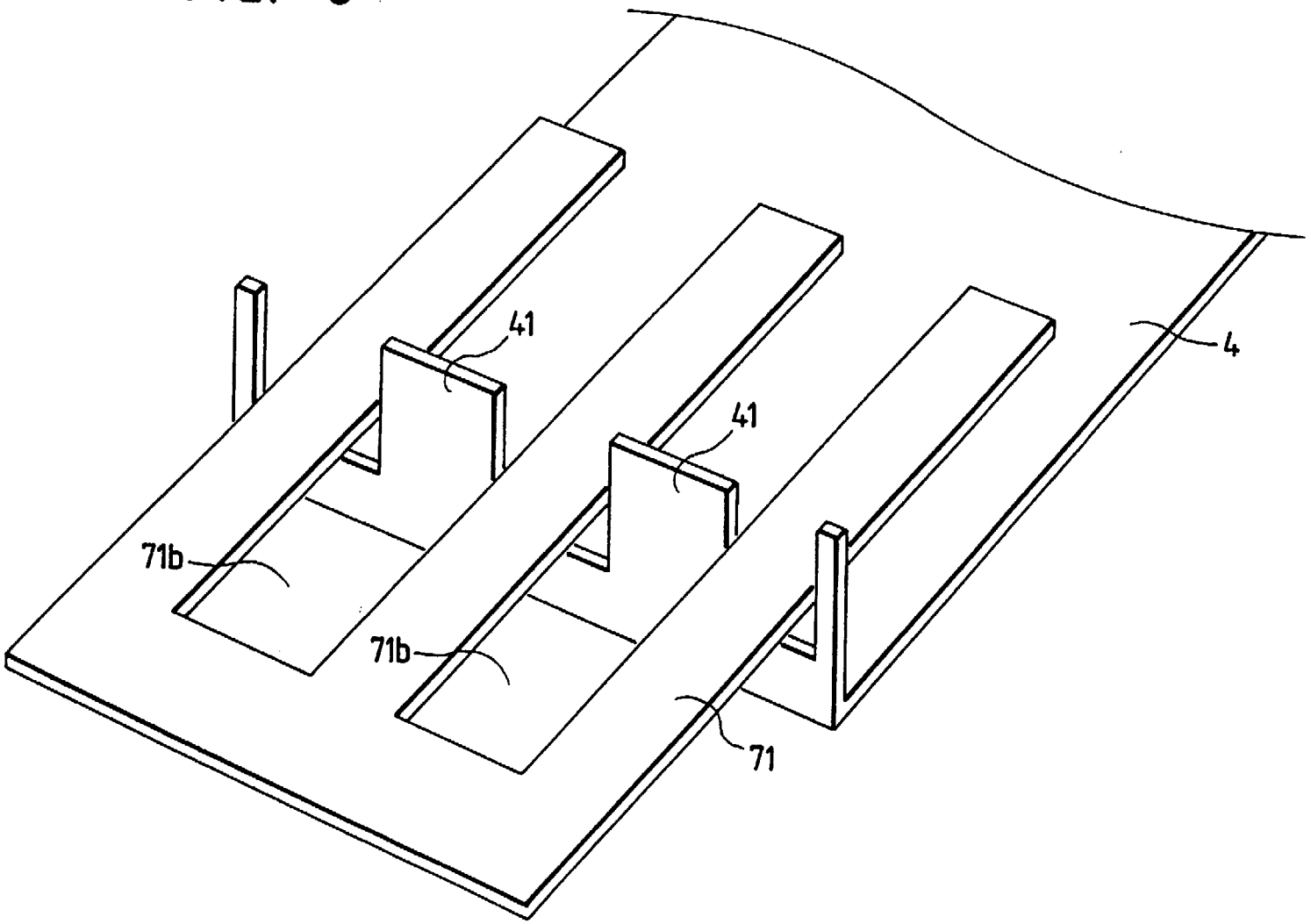
FIG. 6 is a perspective view of the auxiliary containing means.

Next, a sheet convey apparatus according to the present invention provided in the lift/lower convey member 6 will be fully described with reference to FIGS. 3 and 4. FIG. 3 is a plan view of the lift/lower convey member 6 and FIG. 4 is a sectional view taken along the line 4—4 in FIG. 3. FIG. 5 is a plan view of an auxiliary containing means and FIG. 6 is a view showing a condition that the auxiliary containing means is protruded on the way.

A convey belt 63 is mounted around two or more rollers including a drive roller 64 (in the illustrated embodiment, one drive roller 64 and two driven rollers 64*a*, 64*b*). Driven sponge rollers 61 made of polyurethane form material are disposed above the convey belt 63. The rollers 61, 64, 64*a*, 64*b* are rotatably supported by a frame 67. Hardness of each sponge roller 61 is preferably selected within a range from 5 to 35 Kg/0.09 $m^2$ (compression of 2.5%), and, in the illustrated embodiment, the hardness of each sponge roller is selected to 17 Kg/0.09 $m^2$.

The sponge rollers 61 are pinched by flanges 62 at both sides thereof are contacted with the flanges 62 is a predetermined area range. In the illustrated embodiment, a diameter of each sponge roller 61 is 80 mm, and a diameter of each flange 62 is 50 mm smaller than that of the sponge roller by 30 mm, because it is ensured that elastic deformation of the sponge rollers 61 is not prevented and the sponge rollers 61 are prevented from falling laterally.

Shafts 69 of the sponge rollers 61 are rotatably supported in elongated slots formed in the frame 67 via bearings (not shown) to ensure a minimum distance between the shafts 69 and 68. Pressurizing springs disposed within the elongated slots serve to urge the sponge rollers 61 downwardly. With this arrangement, the sponge rollers 61 are normally fixed at their minimum distance positions to convey the sheet or the sheet bundle. However, when the sheet bundle having the thickness greater than the predetermined thickness is conveyed, the sponge rollers can be shifted upwardly in opposition to biasing forces of the pressurizing springs 66.

A sensor lever 65*a* and a photo-sensor 65 are disposed at an upstream side of the sponge rollers 61 so that, when the sheet bundle having the thickness greater than the predetermined thickness is conveyed, the convey timing of the sheet bundle is detected, whereby, when the sheet bundle enters into nips (contact portions) of the sponge rollers 61, the convey speed of the sheet bundle is decreased to damp the impinging shock of the sheet bundle. Further, the right (downstream) sponge rollers 61 must have a function for convey the single sheet or the sheet bundle and for discharging it onto the tray of the containing portion 4, and, thus, a straight line connecting between centers of the drive roller shaft 68 and the sponge roller shaft 69 is inclined by an angle of 15 degrees with respect to the vertical direction to provide an upward discharge angle of 15 degrees for the sheet.

Further, in the illustrated embodiment, four sponge rollers 61 are mounted on the common shaft disposed at the discharge side, and two of the rollers have diameters (60 mm) smaller than those of the remaining rollers. With this arrangement, for the thick sheet bundle which requires the large discharge force, the sheet bundle can be pinched and discharged by all of four sponge rollers 61. When the sheet bundle enters into the nips of the sponge rollers 61, since the sheet bundle is not impinged against the smaller sponge rollers 61*a* strongly, it is possible to damp the impinging shock of the sheet bundle.

As shown in FIG. 4, an auxiliary containing tray 71 is disposed below the drive roller 64 and has an inclination angle substantially the same as that of the tray 4. Further, as shown in FIGS. 5A to 5C, a rack 71*a* is provided on the tray 71 at a central portion thereof so that a shifting amount of the tray can be controlled correctly. In addition, a detected portion 75 is provided on one end of the tray so that the detected portion 75 can be detected by a photo-sensor 76 to determine a home position of the tray. A counter can determine whether the tray reaches an entrance position for the sponge rollers.

The posture of the auxiliary containing tray 71 is regulated by support rollers 73, 73*a*, a drive gear 72 and a drive roller 72*a*, and a lateral position of the tray is regulated by side regulation members 74. The auxiliary containing tray 71 has an E-shaped configuration (FIG. 5A) including groove portions 71*b* within which upwardly bent portions 41 of the tray 4 are inserted (FIG. 6). FIG. 6 shows a condition that the auxiliary containing tray 71 is protruded from the tray 4. In the illustrated embodiment, while two groove portions 71*b* were provided, only one groove portion may be provided. Further, the greater the number of the groove portions, the greater the stability for dropping the sheet. The reference numeral 77 denotes a rib.

The containing portion 4 (refer to FIG. 2) having the trays 4*a* to 4*o* arranged side by side in the vertical direction serves to receive and contain the sheets or the sheet bundles (on which images were formed) sent from the lift/lower convey member 6. The trays 4*a* to 4*o* can be shifted in a front-and-rear direction so that the operator can remove the sheet and the sheet bundle from the desired tray by retracting the tray toward the operator's side. Further, in order to align tip ends of various sheets even when the various sheets having different sizes are stacked on the tray, the trays 4*a* to 4*o* are inclined downwardly in the left direction.

Next, an operation of the sheet sorting and containing apparatus 1 having the above-mentioned construction will be explained with reference to FIGS. 7 to 15 showing the operation.

(Single Sheet)

Figure 7:
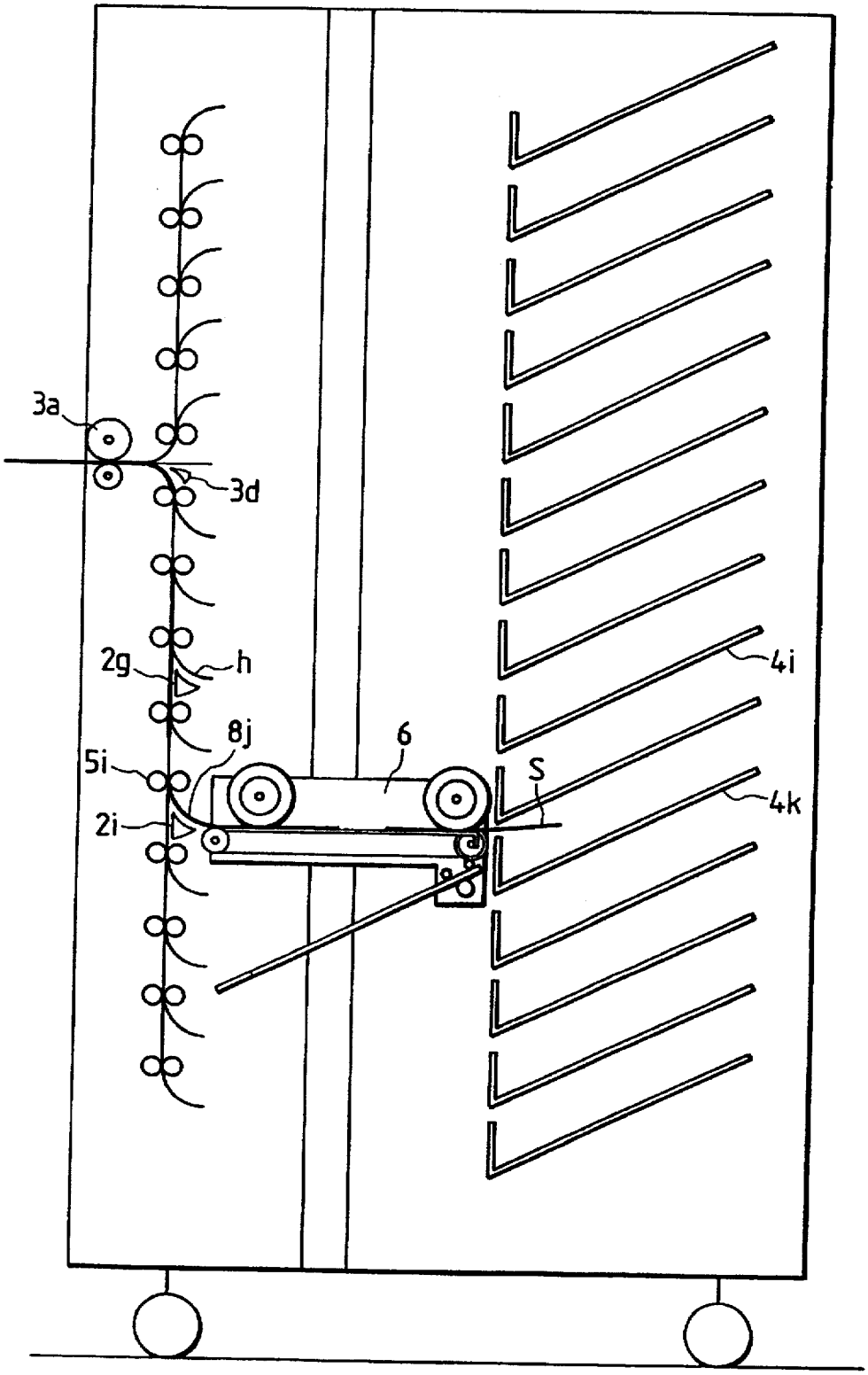
FIGS. 7 to 10 are views for explaining an operation of the sheet distribution apparatus of FIG. 2 (regarding sheets)

As shown in FIG. 7, when it is desired to contain a sheet S in the tray 4*k* of the containing portion 4, first of all, the lift/lower convey member 6 is lifted to the level corresponding to the tray 4*k* and then is stopped there. As a result, an entrance portion of the lift/lower convey member 6 is aligned with the branch path 8*j*. The flapper 2*i* is switched to direct the sheet S toward the branch path 8*j*. The flapper 3*d* is switched to direct the sheet toward a lower portion of the vertical convey path 2. Accordingly, the sheet S is directed to the lift/lower convey member 6 through the pair of inlet rollers 3*a*, vertical convey path 2, and branch path 8*j*.

Similarly, when it is desired to contain the sheet S in the tray 4*i*, the lift/lower convey member 6 is lifted to the level corresponding to the tray 4*i* and then is stopped there, and the flapper 2*g* in the vertical convey path 2 corresponding to the tray 4*i* and the flapper 3*d* in the sheet inlet portion 3 are switched.

In this way, the sheets S can be sorted in the trays arranged side by side in the vertical direction. Incidentally, after the sheet S are stapled by the stapling apparatus 104 (FIG. 1), if the stapled sheet bundle is relatively thin, such a sheet bundle can be contained in the tray 4*a* to 4*o* in the same manner as described above.

Figure 8:
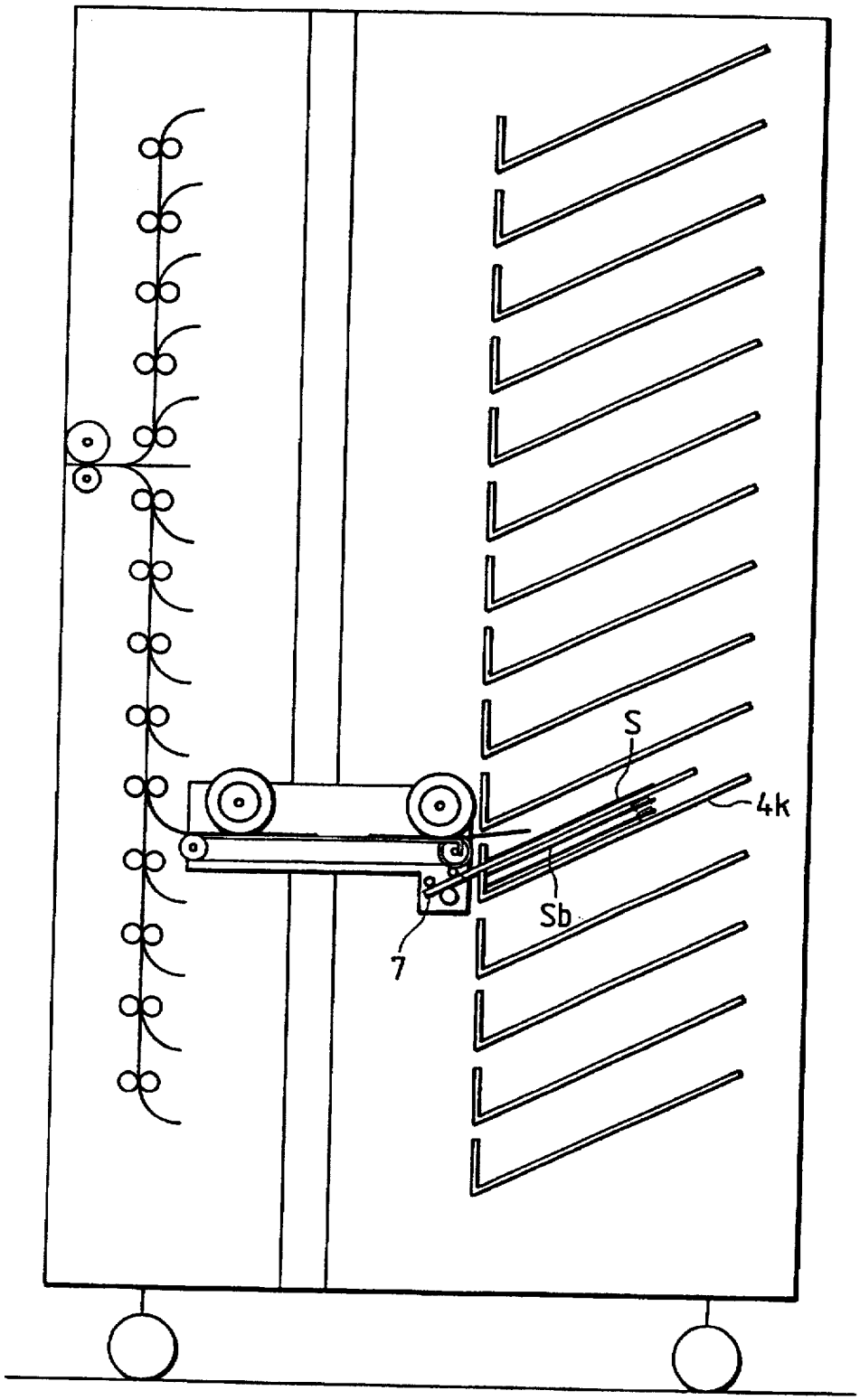
Figure 9:
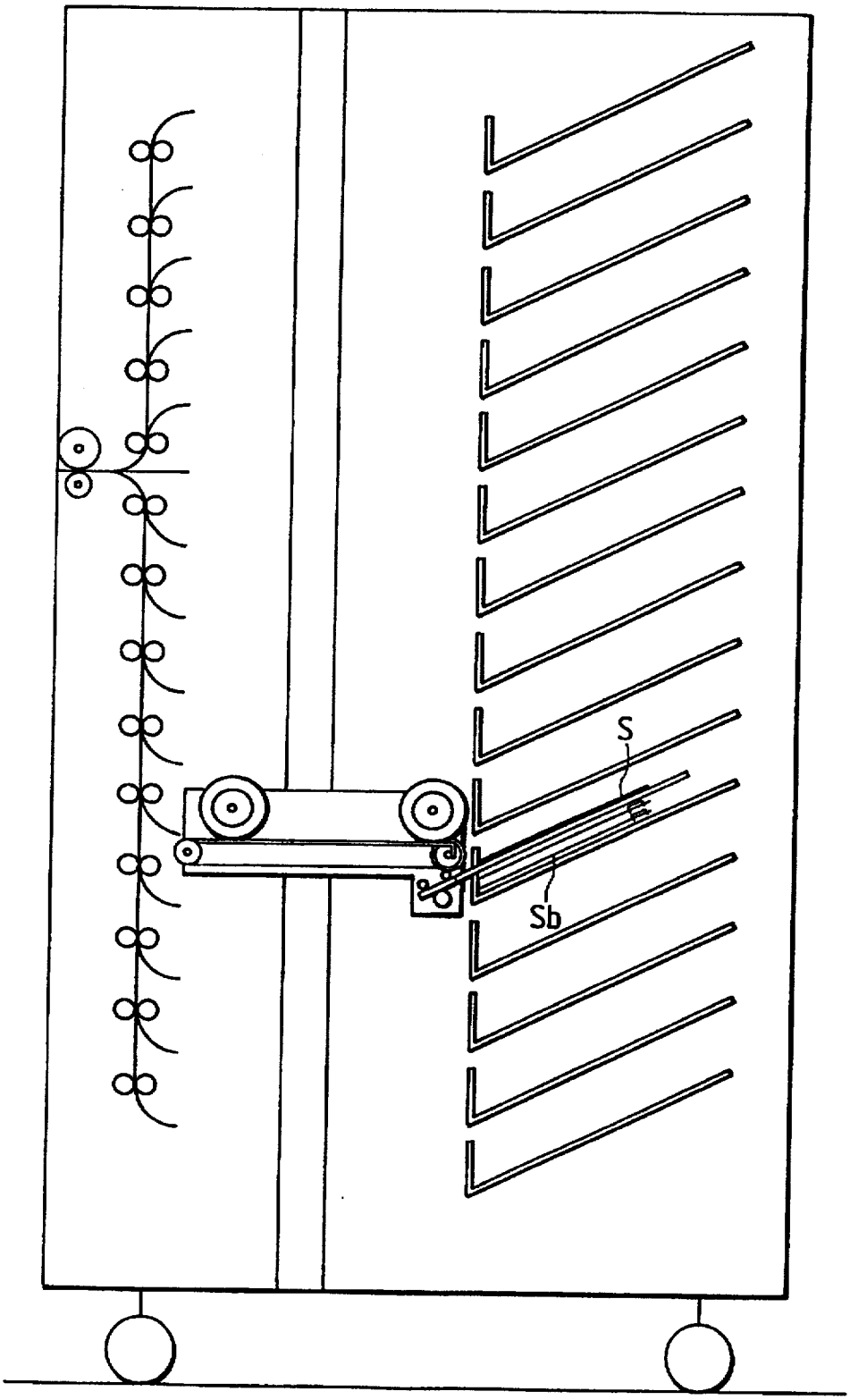
Figure 10:
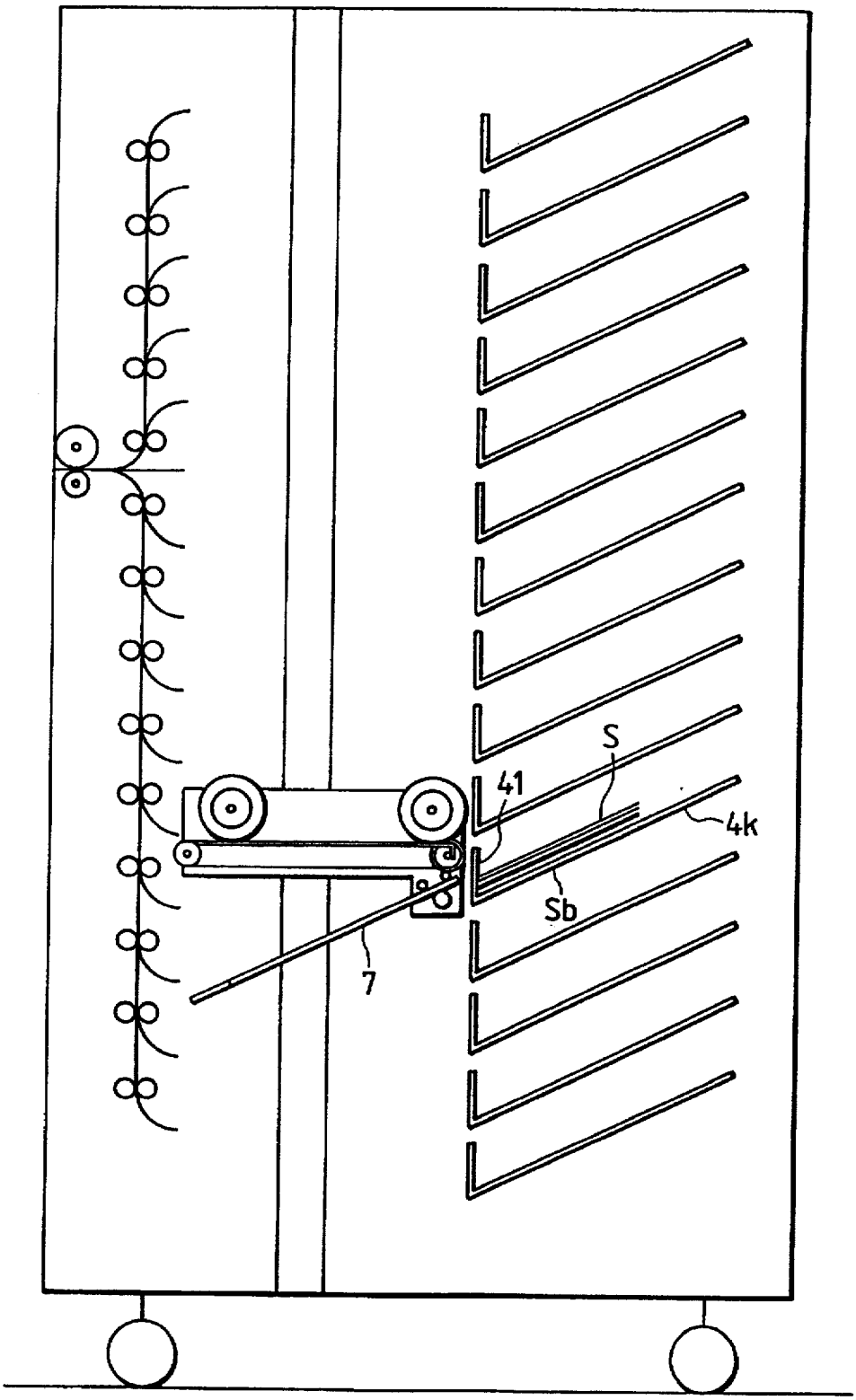

FIGS. 8, 9 and 10 show an operation when the stapled sheet bundles Sb were already contained in the tray 4.

In this case, first of all, the auxiliary containing tray 71 is shifted from its home position to protrude above the tray 4*k* (FIG. 8) by rotating the motor for a predetermined time period. Then, the sheet S is discharged onto the auxiliary containing tray 71 (FIG. 9). After a predetermined number of sheets were discharged onto the auxiliary containing tray, the latter is returned to the home position at a predetermined speed (FIG. 10). The returning speed of the auxiliary containing tray 71 is preferably 200 mm/sec or more, and, in the illustrated embodiment, the tray is returned at a speed of 500 mm/sec. The plurality of sheets S stacked on the auxiliary containing tray 71 are regulated by the upwardly bent portions 41 to be stopped (not to shift together with the auxiliary containing tray 71), with the result that the sheets S are dropped onto the tray 4*k*. In this case, when the pulling speed of the tray 71 is high, the sheets S are dropped in a flat condition; whereas, when the pulling speed is relatively low, the sheets S are gradually shifted downwardly from tip ends thereof.

(Thick Sheet Bundle)

Figure 11:
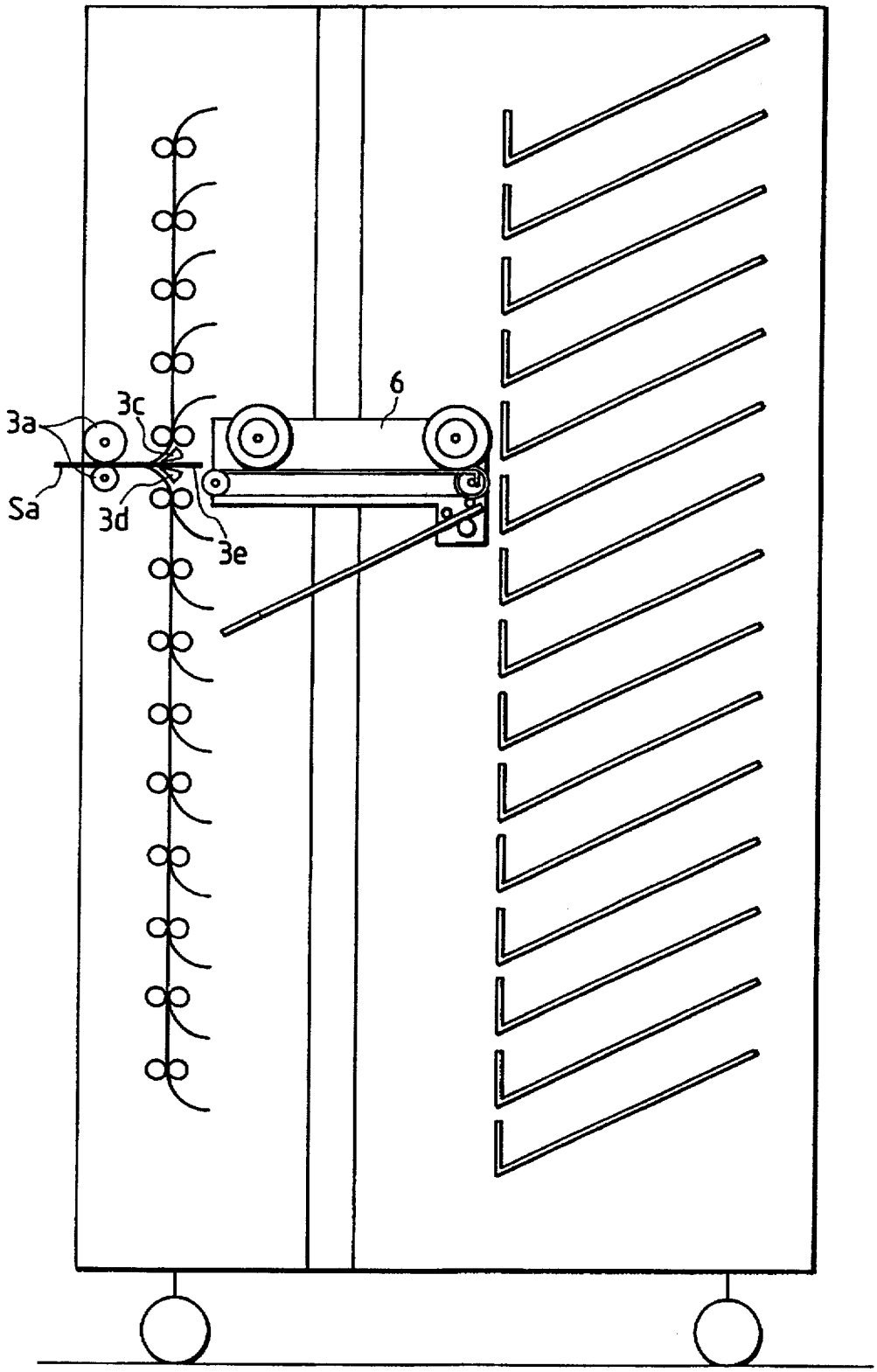
FIGS. 11 to 15 are views for explaining an operation of the sheet distributing apparatus of FIG. 2 (regarding a sheet bundle)
Figure 12:
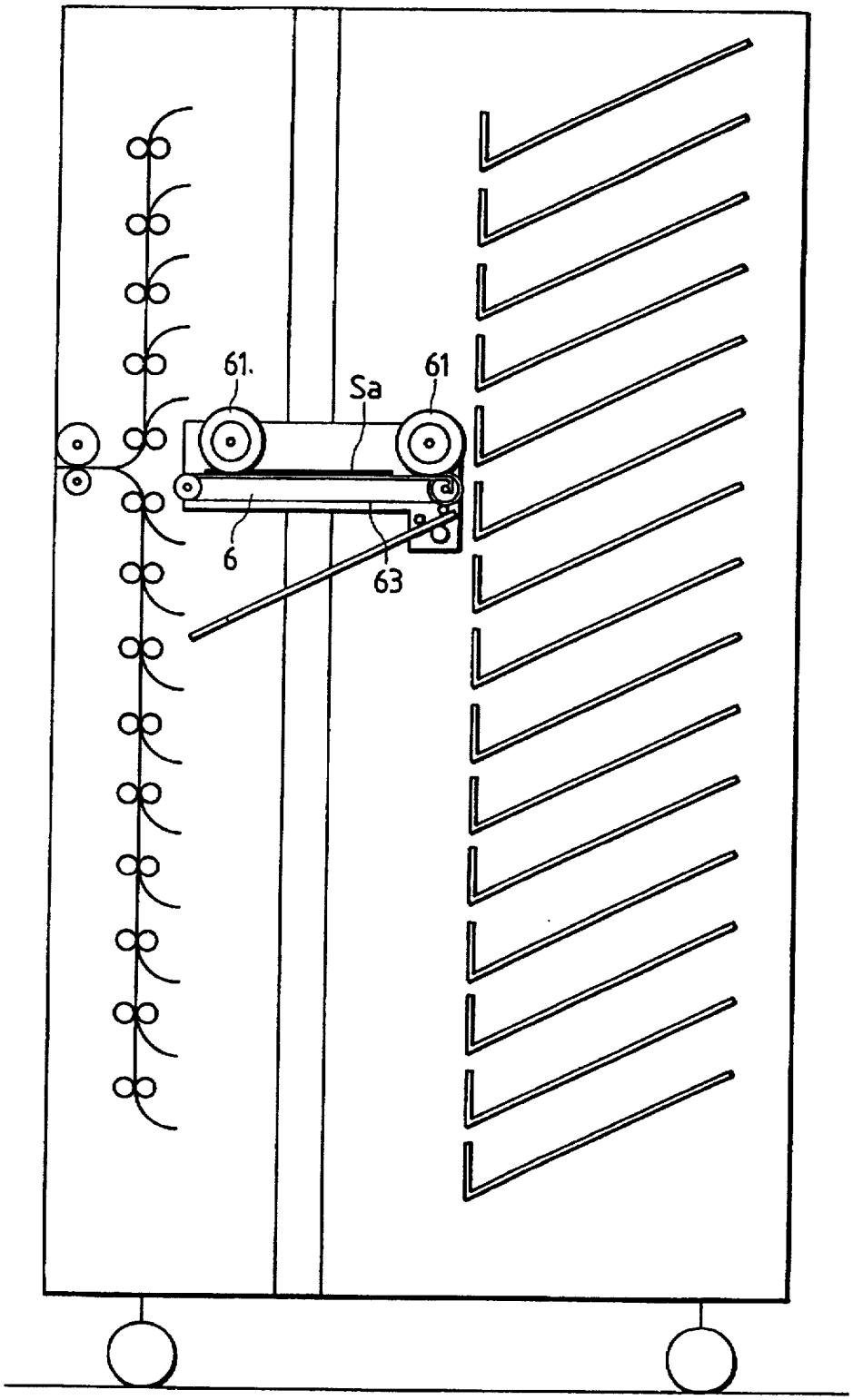

As shown in FIG. 11, the lift/lower convey member 6 is shifted to align with the straight path 3*e* of the sheet inlet portion 3 and is then stopped there. The flappers 3*c*, 3*d* are switched to direct a sheet bundle Sa toward the straight path 3*e*. Thus, the sheet bundle Sa is pinched between the sponge rollers 61 and the convey belt 63 of the lift/lower convey member 6, as shown in FIG. 12.

Figure 13:
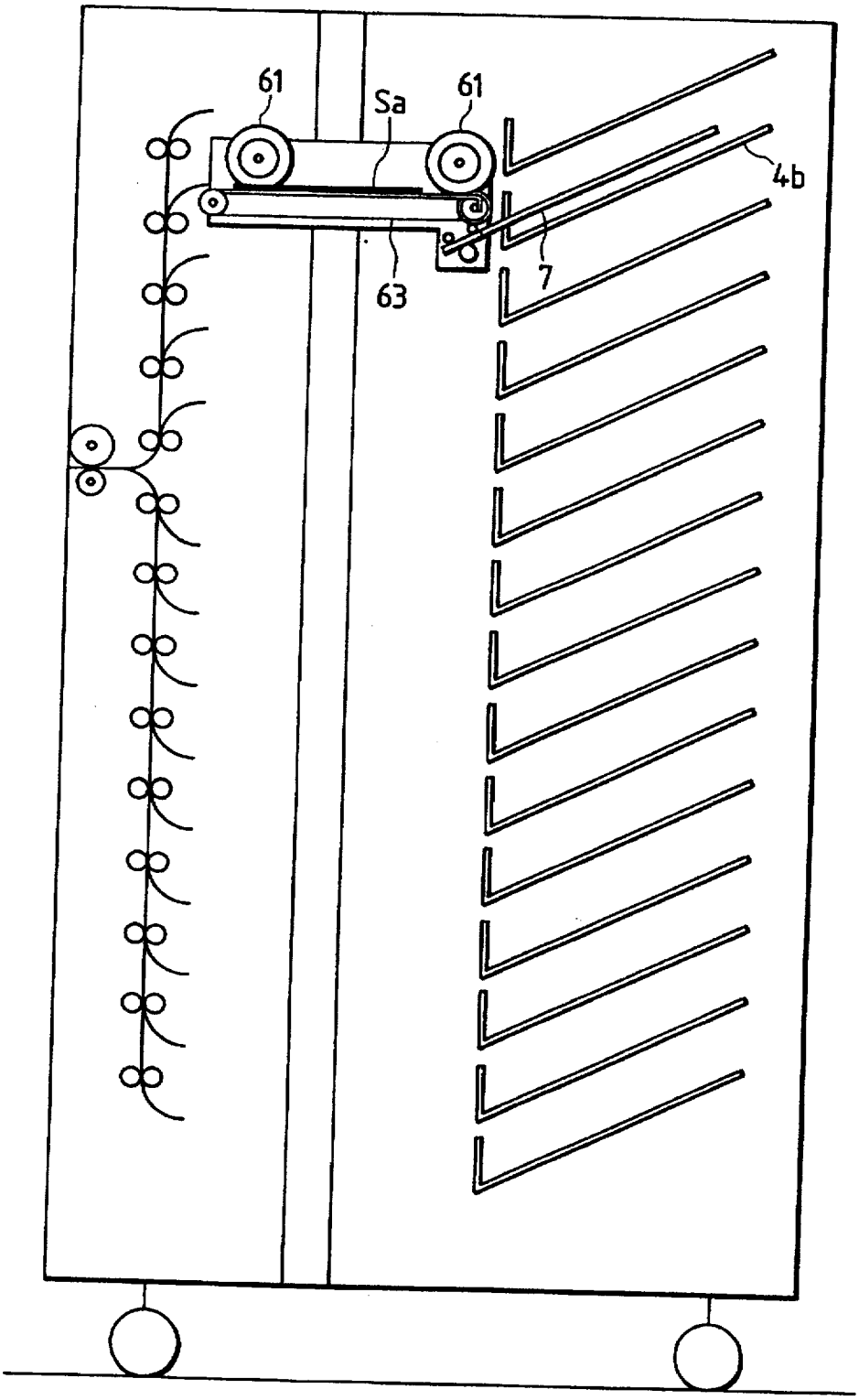
Figure 14:
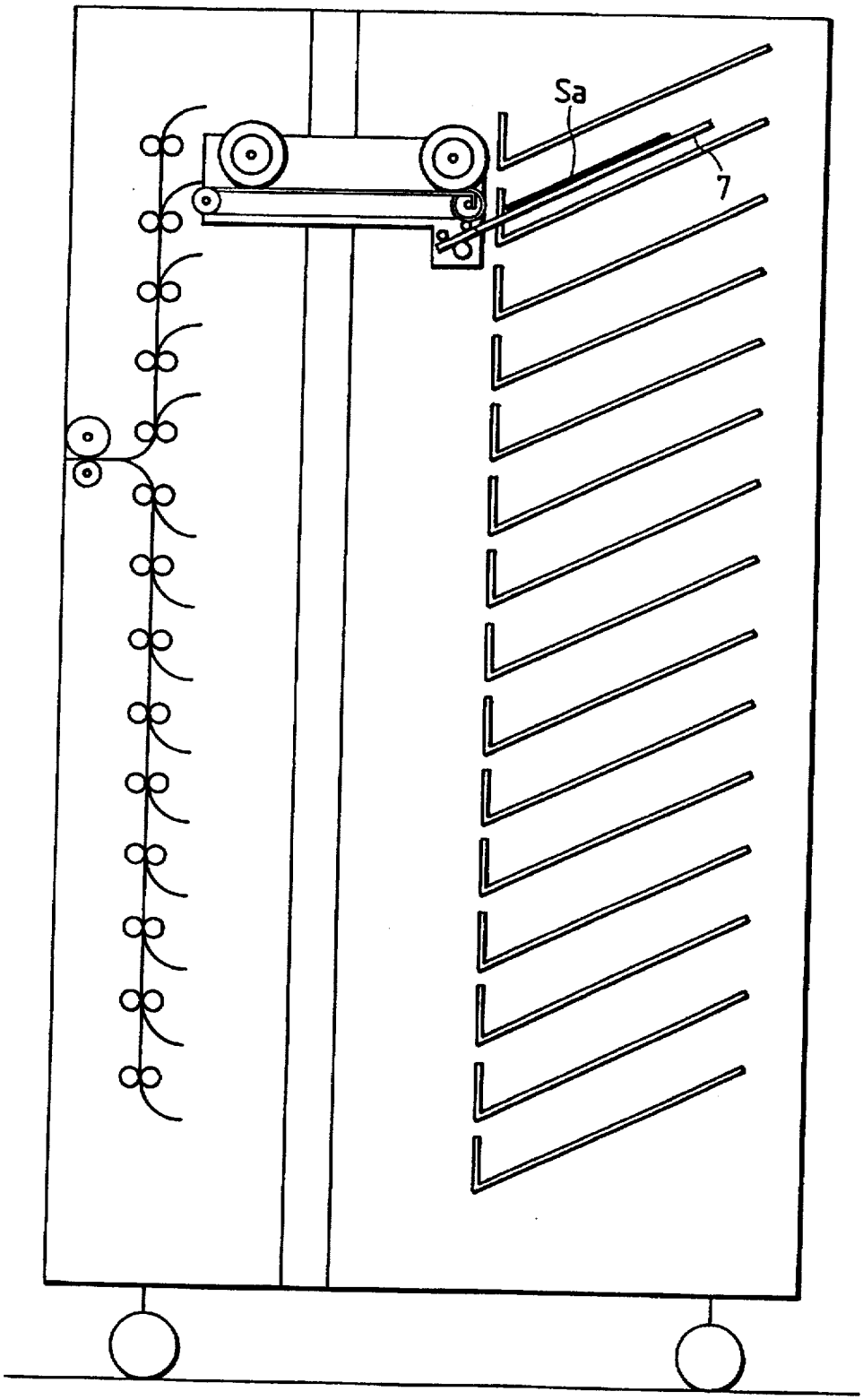

Then, as shown in FIG. 13, the lift/lower convey member is lifted to the level of the desired tray (for example, tray 4*b*) and is then stopped there. Then, the auxiliary containing tray 71 is protruded above the tray 4*b*. Thereafter, the sponge rollers 61 and the convey belt 63 are rotated to discharge the sheet bundle Sa onto the auxiliary containing tray 71 (FIG. 14).

Figure 15:
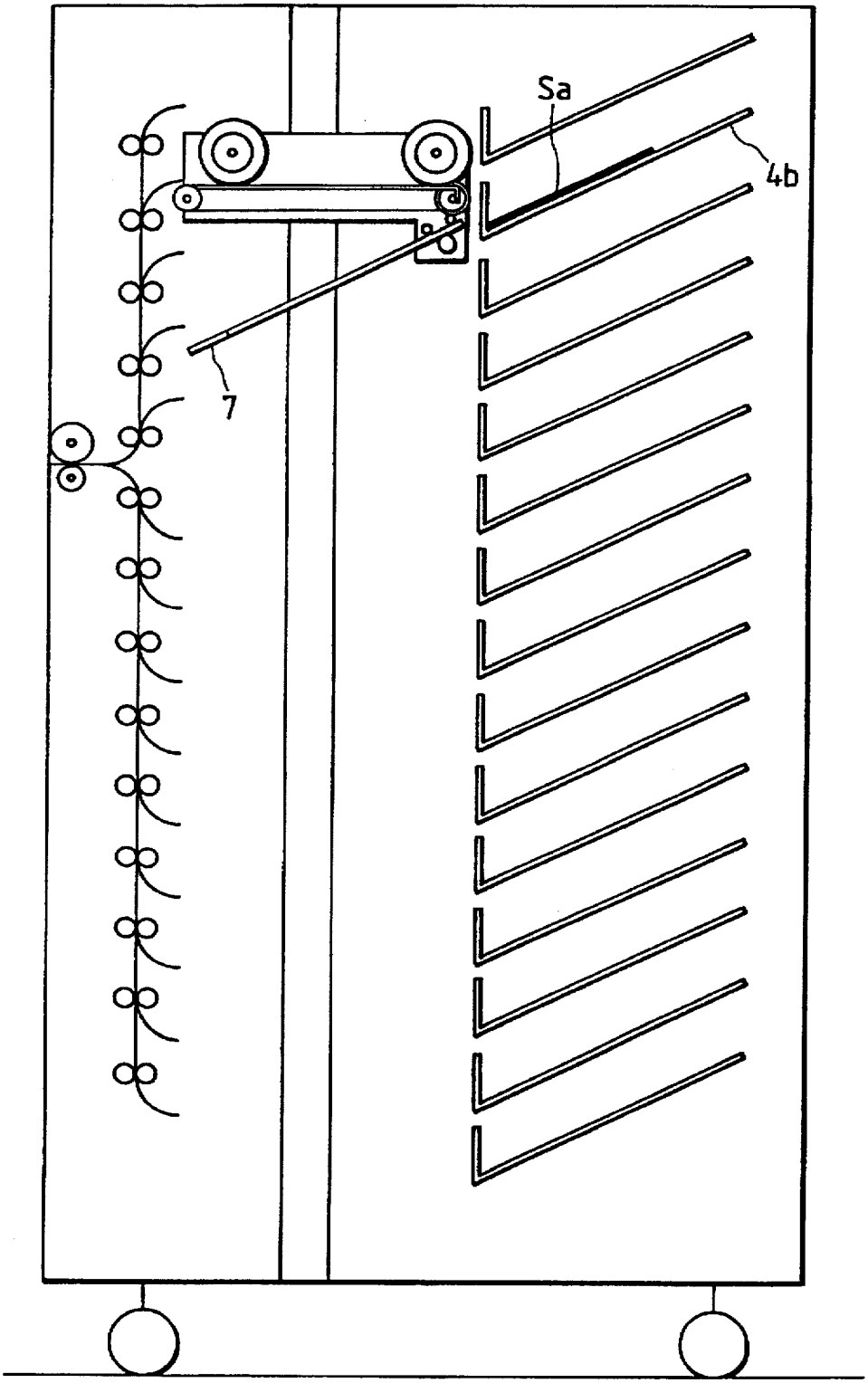

Then, as shown in FIG. 15, the auxiliary containing tray 71 is returned to the initial position at a predetermined speed. Consequently, the sheet bundle Sa is dropped onto the tray 4b and contained therein. Thereafter, the lift/lower convey member 6 is lowered (refer to FIG. 2) to align with the straight path 3e for preparation for a next sheet bundle. In this way, the sheet bundles can be sorted in the trays 4a to 4o of the containing portion 4.

(SECOND EMBODIMENT)

Figure 16:
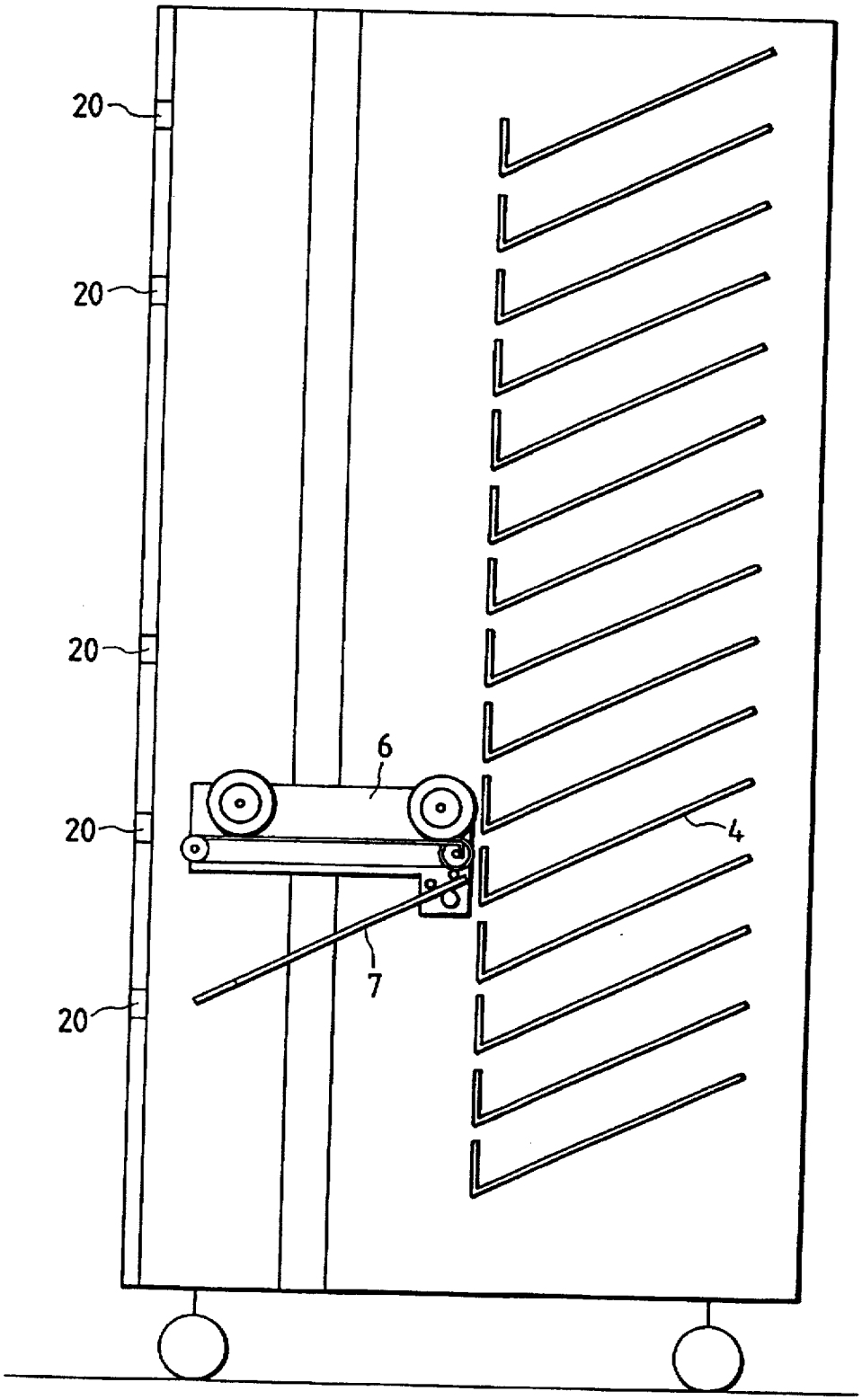
FIG. 16 is an elevational sectional view showing another embodiment.

FIG. 16 shows a second embodiment of the present invention.

This second embodiment differs from the first embodiment in the points that the vertical convey path 2 and the sheet inlet portion 3 are omitted and a plurality of inlet portions 20 or a shiftable inlet portion are added. With this arrangement, the manufacturing cost can be reduced and the apparatus can be used with various kinds of image forming apparatuses and book-binding apparatuses.

(THIRD EMBODIMENT)

Figure 17:
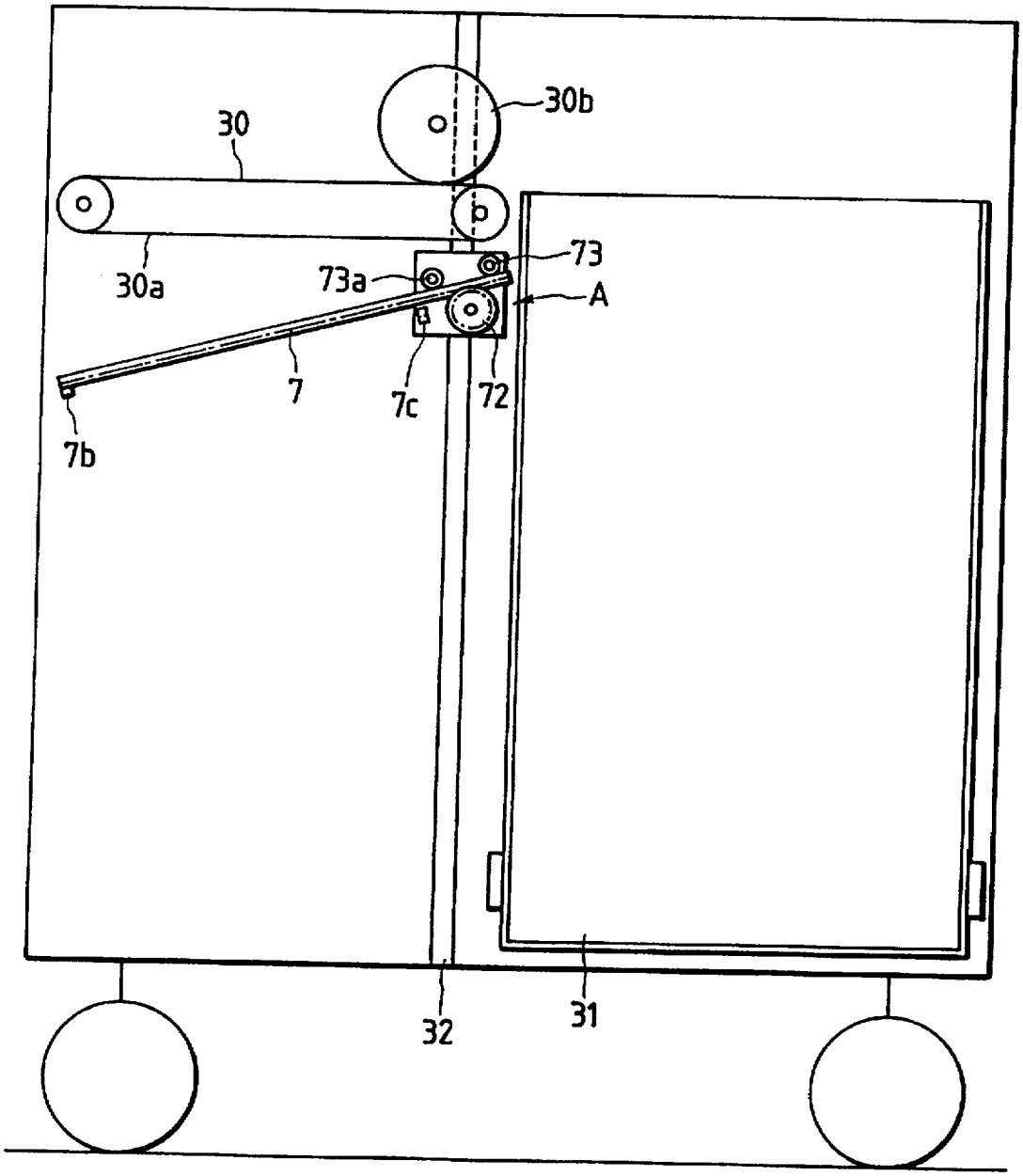
FIG. 17 is an elevational sectional view showing a further embodiment.
Figure 18:
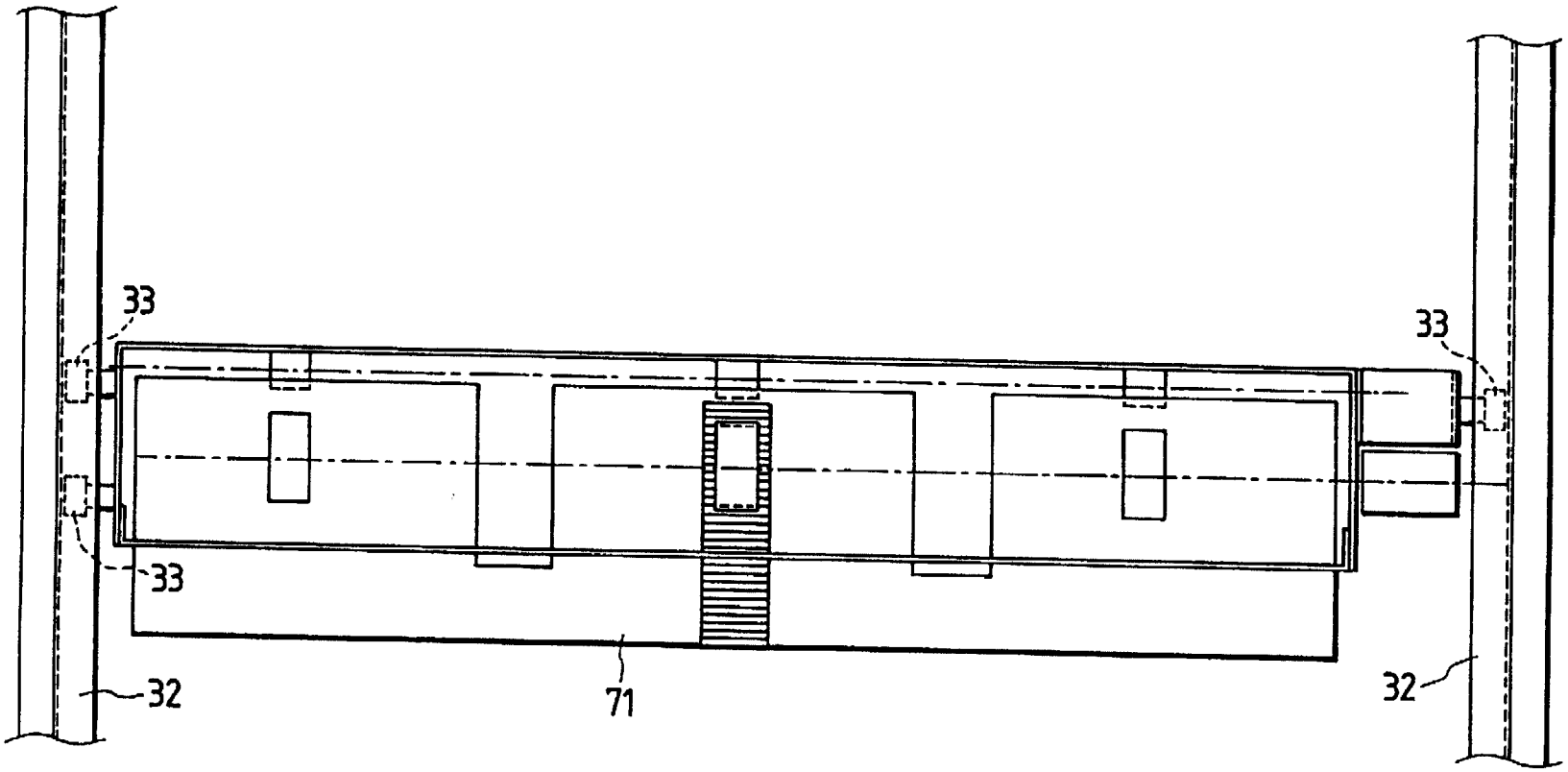
FIG. 18 is a view looked at from a direction shown by the arrow A in FIG. 17.
Figure 19:
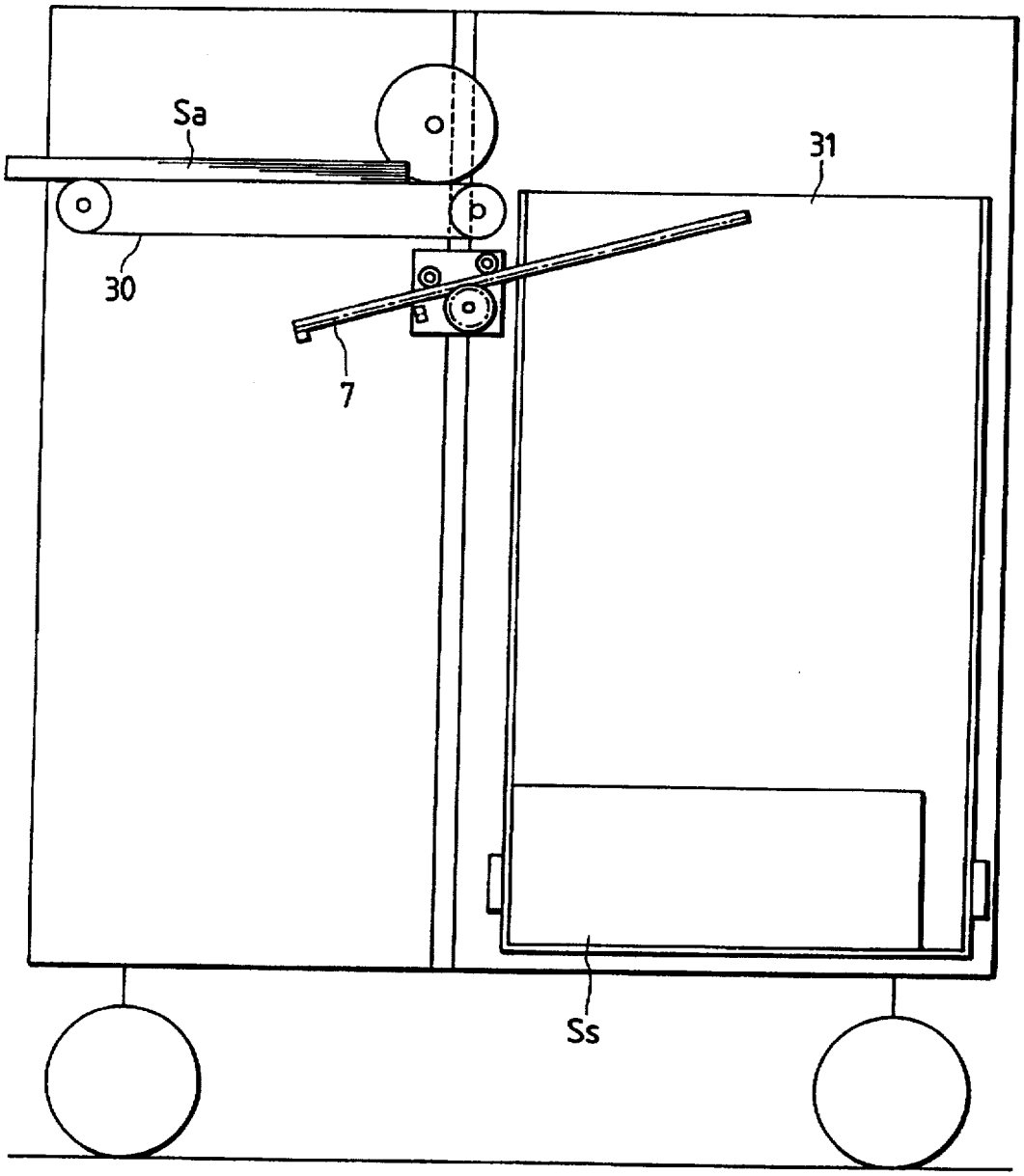
FIGS. 19 to 22 are views for explaining an operation of the embodiment of FIG. 17.

FIGS. 17 and 18 show a third embodiment of the present invention. Incidentally, FIG. 18 is a view looked at from a direction shown by the arrow A in FIG. 17.

In this embodiment, an auxiliary containing means 7 is applied to a stacker having large capacity. An inlet convey portion 30 comprises a convey belt 30a and sponge rollers 30b and serves to receive a sheet or a sheet bundle sent from an image forming apparatus or a book-binding apparatus and discharge the sheet or the sheet bundle onto a stacker 31.

An auxiliary containing means 7 has the same construction as that of the first embodiment and is lifted or lowered by lift/lower rails 32, lift/lower rail rollers 33, a drive wire and a drive motor. Incidentally, the reference numerals 7a, 7b denote sensors for detecting the fact that the auxiliary containing means reaches an entrance position.

Next, an operation when a book-bound sheet bundle is treated will be explained with reference to FIGS. 19, 20, 21 and 22.

Figure 20:
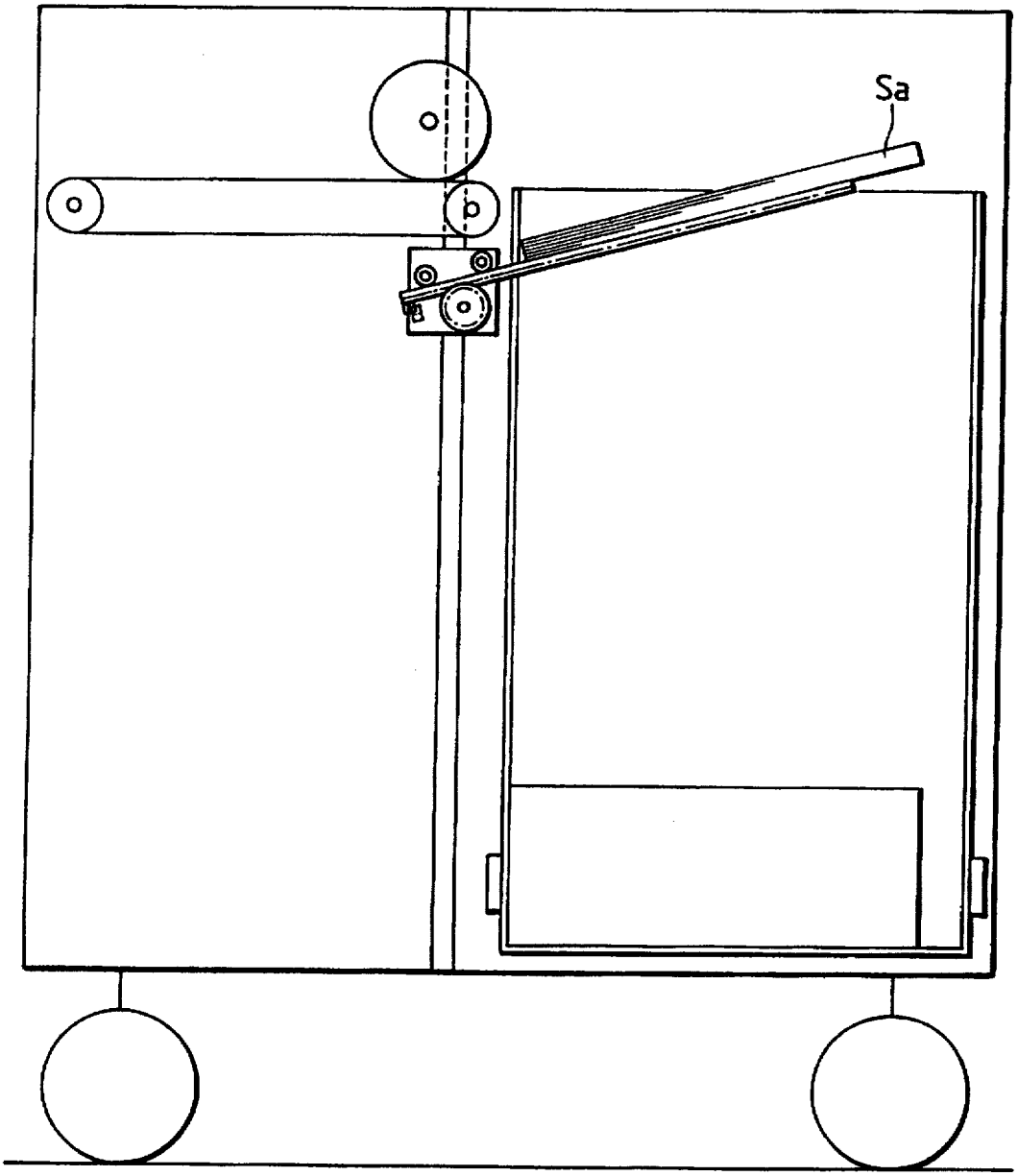
Figure 21:
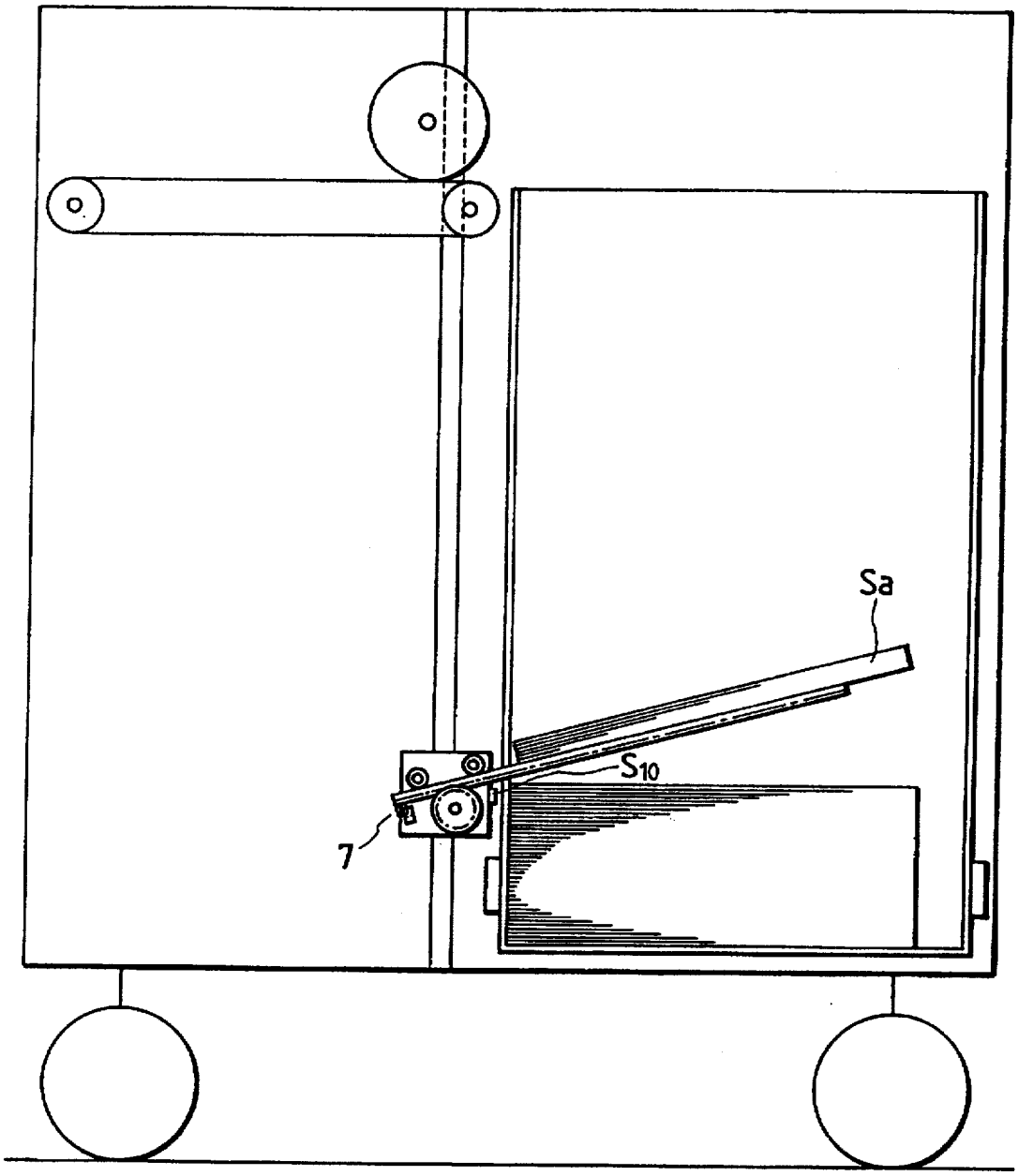
Figure 22:
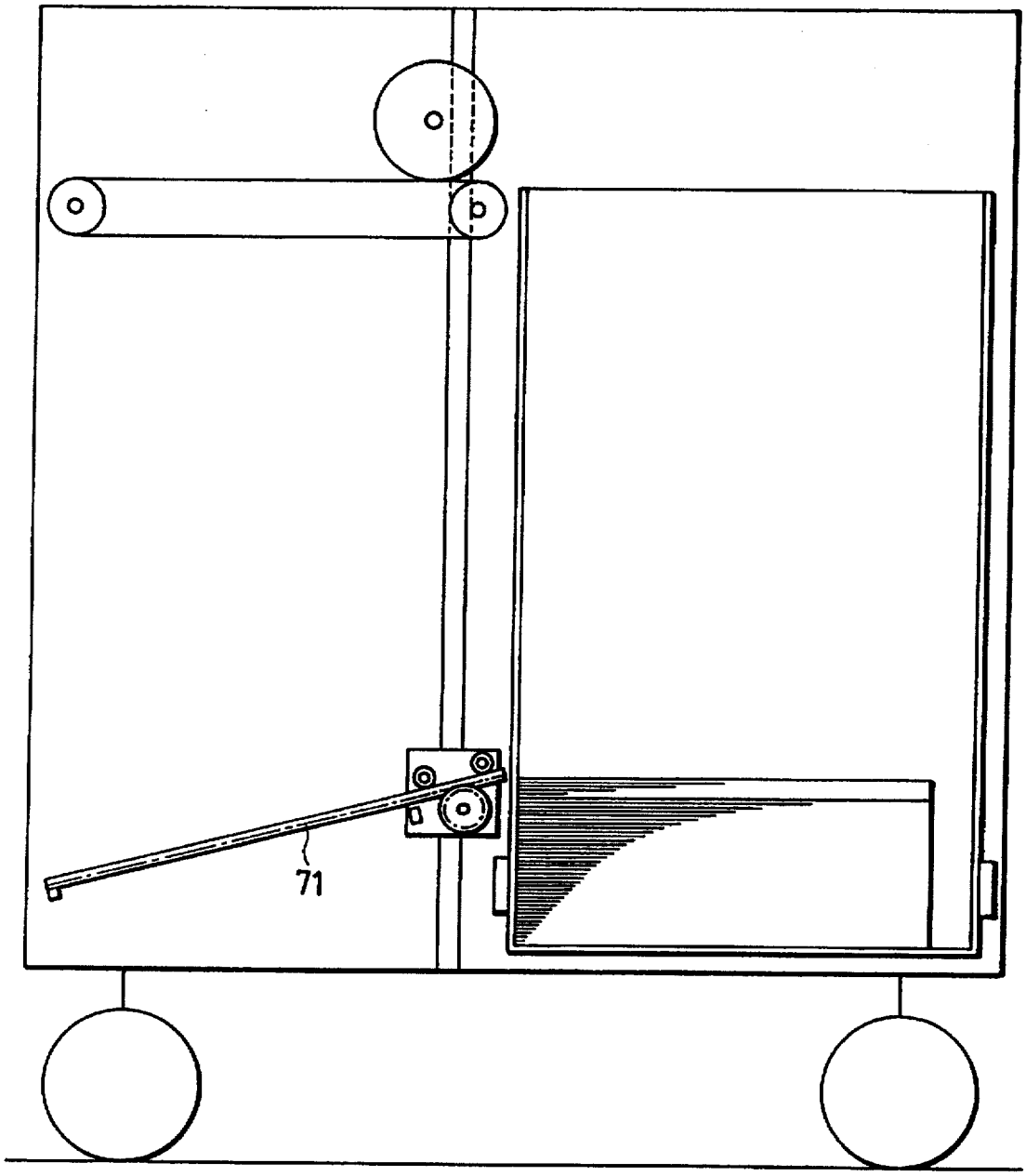
Figure 23:
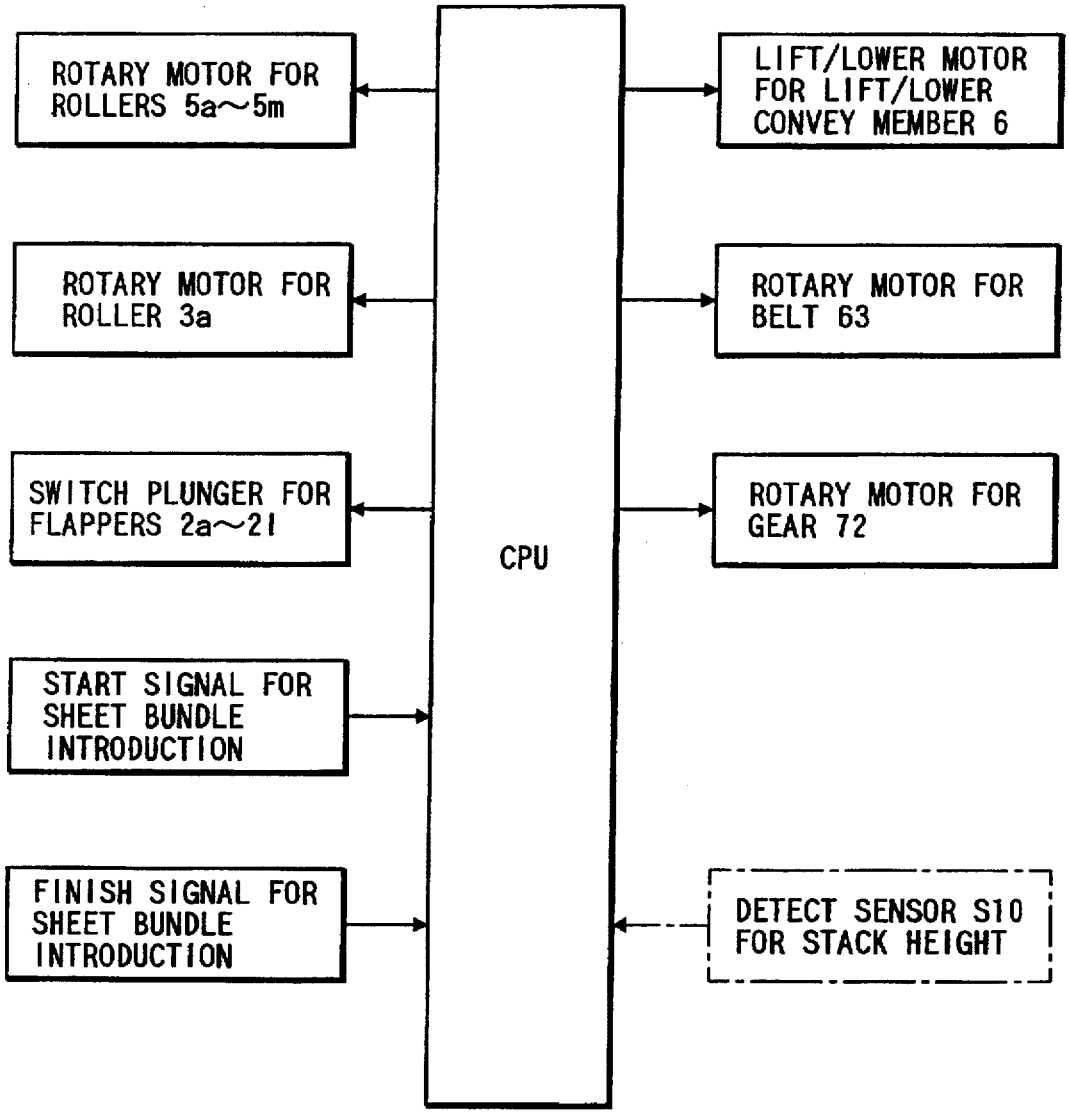
FIG. 23 is a block diagram.
Figure 24A:
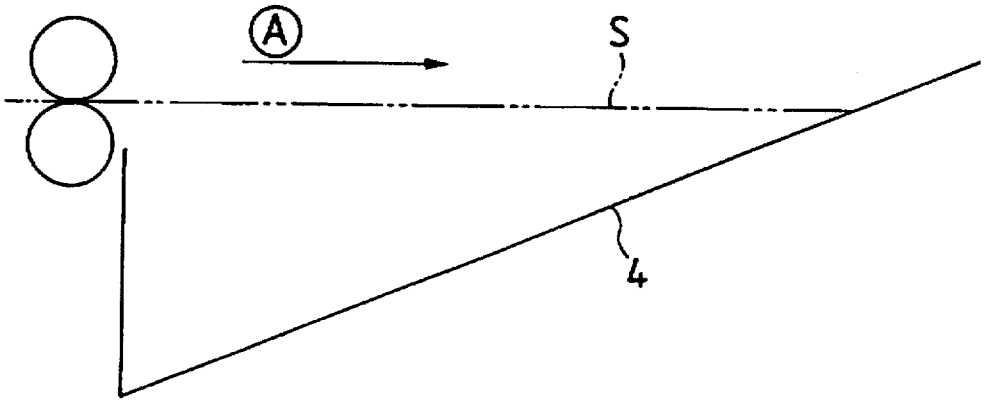
FIG. 24A PRIOR ART
FIGS. 24A and 24B are views for explaining a conventional technique.
Figure 24B:
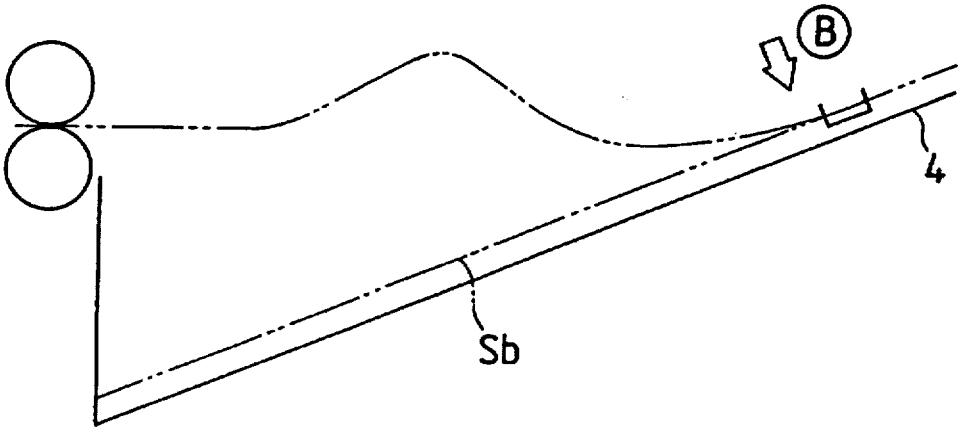
FIG. 24B PRIOR ART

A sheet bundle Sa is conveyed to the right through the inlet convey portion 30. Meanwhile, the auxiliary containing tray 71 is protruded above the stacker 31. Then, the sheet bundle Sa is discharged onto the auxiliary containing tray 71 (FIG. 20). Then, the auxiliary containing means 7 is lowered below the stacker (FIG. 21). Thereafter, the auxiliary containing tray 71 is returned to the home position, and the sheet bundle Sa is dropped (FIG. 22).

With this arrangement, sheets or sheet bundles having various sizes can be stably stacked in combination, or, sheets or sheet bundles having the same size can be stacked.

A means for stopping the auxiliary containing means 7 at a position shown in FIG. 21 (on the upper surface of the sheet bundle already stacked) may be a sheet surface detection means (sensor) S10 provided on the side of the auxiliary containing means 7. By the action of this sensor S10, the auxiliary containing means can be stopped at a desired level. The sensor S10 controls the above-mentioned drive motor.

What is claimed is:

1. A sheet containing and stacking apparatus including sheet bundle discharge means and stack means for stacking the discharged sheet bundles, comprising:

auxiliary containing means reciprocally shiftable between an entrance position where said auxiliary containing means receives the sheet bundle discharged from said sheet bundle discharge means, and a retard position where the received sheet bundle is shifted to said stacking means; and control means for reciprocally shifting said auxiliary containing means whenever the sheet bundle is stacked on said stacking means;

wherein a plurality of sheet bundles are successively stacked on said stacking means in an overlapped condition.

2. A sheet containing and stacking apparatus according to claim 1, wherein, when sheets are discharged one by one, said auxiliary containing means is held at said retard position.

3. A sheet containing and stacking apparatus according to claim 1, wherein the sheet bundle is stapled by a stapler.

4. A sheet containing and stacking apparatus according to claim 1, wherein said stacking means has a plurality of bin trays arranged side by side in a vertical direction.

5. A sheet containing and stacking apparatus according to claim 4, wherein said sheet bundle discharge means and said auxiliary containing means are integrally lifted and lowered along an arranging direction of said bin trays.

6. A sheet containing and stacking apparatus according to claim 1, wherein said stacking means is inclined so that an upstream end the sheet bundle in a sheet discharging direction becomes lower than the other end of the sheet bundle; said auxiliary containing means has a plate-shaped member supported and inclined at substantially the same angle as that of said stacking means; and said sheet bundle discharge means discharges the sheet bundle substantially horizontally.

7. A sheet containing and stacking apparatus according to claim 6, wherein said stacking means has a plurality of bin trays arranged side by side in a vertical direction.

8. A sheet containing and stacking apparatus comprising:

sheet discharge means;

stacking means for stacking the sheets discharged from said sheet discharge means;

auxiliary containing means reciprocally shiftable between an entrance position where said auxiliary containing means receives the sheet discharged from said sheet discharge means, and a retard position where the received sheet is shifted to said stacking means;

lift/lower means for lifting and lowering said auxiliary containing means; and control means for controlling said auxiliary containing means in such a manner that, after said auxiliary containing means receives the sheet at the lifted position and said entrance position, said auxiliary containing means is lowered and then is returned to said retard position.

9. A sheet containing and stacking apparatus according to claim 8, wherein said sheet discharge means can also discharge a sheet bundle.

10. A sheet containing and stacking apparatus according to claim 9, wherein the sheet bundle is stapled by a stapler.

11. A sheet containing and stacking apparatus according to claim 8, further comprising detection sensor means for detecting the lifted position and lowered position of said auxiliary containing means.

12. A sheet containing and stacking apparatus comprising;

a containing portion including a plurality of trays disposed side by side;

sheet discharge means shiftable along said trays disposed side by side in order to discharge the sheet into a selected tray of said containing portion; and auxiliary containing means reciprocally shiftable an entrance position where said auxiliary containing means receives the sheet discharged from said sheet discharge means, and a retard position where the received sheet is shifted to said tray and also shiftable along said trays disposed side by side.

13. A sheet containing and stacking apparatus according to claim 12, wherein said sheet discharge means and said auxiliary containing means are shifted integrally.

14. A sheet containing and stacking apparatus according to claim 13, wherein said sheet discharge means is constituted in a belt-shaped fashion on that it can also charge a sheet bundle.

15. An image forming apparatus having a sheet containing and stacking apparatus, said sheet containing and stacking apparatus comprising image forming means, bundle forming means for binding sheets on which images were formed to provide a sheet bundle, sheet containing and stacking apparatus including a sheet bundle discharge means and stacking means for stacking the discharged sheet bundles, characterized by that auxiliary containing means reciprocally shiftable between an entrance position where said auxiliary containing means receives the sheet bundle discharged from said sheet bundle discharge means, and a retard position where the received sheet bundle is shifted to said stacking means; and control means for reciprocally shifting said auxiliary containing means whenever the sheet bundle is stacked on said stacking means, wherein a plurality of sheet bundles are successively stacked on said stacking means in an overlapped condition.

16. An image forming apparatus having a sheet containing and stacking apparatus, said sheet containing and stacking apparatus comprising:

image forming means;

sheet discharge means for discharging a sheet on which an image was formed;

stacking means for stacking the sheets discharged from said sheet discharge means;

auxiliary containing means reciprocally shiftable between an entrance position where said auxiliary containing means receives the sheet discharged from said sheet discharge means, and a retard position where the received sheet is shifted to said stacking means;

lift/lower means for lifting and lowering said auxiliary containing means; and control means for controlling said auxiliary containing means in such a manner that, after said auxiliary containing means receives the sheet at the lifted position and said entrance position, said auxiliary containing means is lowered and then is returned to said retard position.

17. An image forming apparatus having a sheet containing and stacking apparatus, said sheet containing and stacking apparatus comprising:

image forming means;

a containing portion including a plurality of trays disposed side by side for containing sheets on which images were formed;

sheet discharge means shiftable along said trays disposed side by side in order to discharge the sheet into a selected tray of said containing portion; and auxiliary containing means reciprocally shiftable an entrance position where said auxiliary containing means receives the sheet discharged from said sheet discharge means, and a retard position where the received sheet is shifted to said tray and also shiftable along said trays disposed side by side.

* * * * *

UNITED STATES PATENT AND TRADEMARK OFFICE

CERTIFICATE OF CORRECTION

PATENT NO. : 5,695,181

DATED : December 9, 1997

INVENTOR(S) : Yuji YAMANAKA

It is certified that error appears in the above-identified patent and that said Letters Patent is hereby corrected as shown below:

Column 1

Line 26, "arises" should read --arise--.

Column 2

Line 10, "On" should read --on--.

Column 3

Line 38, "stapler" should read --stapler,--.

Column 4

Lines 56-57, "are contacted with the flanges 62 is a predetermined area range." should read --and contact a predetermined area of the flanges.--

Column 5

Line 16, "for" should read --to--.

Signed and Sealed this

Eleventh Day of August 1998

Bruce Lehman

*Attest:*

BRUCE LEHMAN

*Attesting Officer*

*Commissioner of Patents and Trademarks*